US005932383A

United States Patent [19]

Nakata et al.

[11] Patent Number: 5,932,383

[45] Date of Patent: Aug. 3, 1999

[54] ELECTROPHOTOGRAPHIC PHOTOSENSITIVE MEMBER AND PROCESS CARTRIDGE AND ELECTROPHOTOGRAPHIC APPARATUS INCLUDING SAME

[75] Inventors: Kouichi Nakata, Numazu; Toshihiro Kikuchi, Yokohama; Koichi Suzuki, Sizuoka-ken; Kazushige Nakamura, Yokohama; Tetsuro Kanemaru, Tokyo, all of Japan

[73] Assignee: Canon Kabushiki Kaisha, Tokyo, Japan

[21] Appl. No.: 08/908,170

[22] Filed: Aug. 7, 1997

[30] Foreign Application Priority Data

Aug. 8, 1996 [JP] Japan ..... 8-209501
Aug. 8, 1996 [JP] Japan ..... 8-209503

[51] Int. Cl.[6] ..... G03G 5/047; G03G 5/09

[52] U.S. Cl. ..... 430/59; 430/83

[58] Field of Search ..... 430/59, 83

[56] References Cited

U.S. PATENT DOCUMENTS

| | | | |
|---|---|---|---|
| 4,853,308 | 8/1989 | Ong et al. | 430/59 |
| 5,024,912 | 6/1991 | Neishi et al. | 430/59 |
| 5,079,118 | 1/1992 | Kikuchi et al. | 430/59 |
| 5,098,809 | 3/1992 | Kikuchi et al | 430/73 |
| 5,227,271 | 7/1993 | Kikuchi et al. | 430/59 |
| 5,238,765 | 8/1993 | Senoo et al. | 430/73 |
| 5,422,210 | 6/1995 | Maruyama et al. | 430/59 |
| 5,486,439 | 1/1996 | Sakakibara et al. | 430/59 |
| 5,616,442 | 4/1997 | Kanemaru et al. | 430/83 |

FOREIGN PATENT DOCUMENTS

| | | |
|---|---|---|
| 0504794 | 9/1992 | European Pat. Off. . |
| 0567396 | 10/1993 | European Pat. Off. . |
| 52-4188 | 2/1977 | Japan . |
| 54-151955 | 11/1979 | Japan . |
| 55-52063 | 4/1980 | Japan . |
| 55-42380 | 10/1980 | Japan . |
| 58-32372 | 7/1983 | Japan . |
| 58-198043 | 11/1983 | Japan . |
| 61-132955 | 6/1986 | Japan . |
| 62-20854 | 1/1987 | Japan . |
| 62-208054 | 9/1987 | Japan . |
| 63-225660 | 9/1988 | Japan . |
| 2-178666 | 7/1990 | Japan . |
| 2-230255 | 9/1990 | Japan . |
| 3-78756 | 4/1991 | Japan . |
| 7-72639 | 3/1995 | Japan . |

*Primary Examiner*—Roland Martin
*Attorney, Agent, or Firm*—Fitzpatrick, Cella, Harper & Scinto

[57] ABSTRACT

An electrophotographic photosensitive member is constituted by a support and a photosensitive layer disposed on the support. The photosensitive layer includes a fluorene compound represented by a formula (1) and a stilbene compound represented by a formula (4). The compounds of the formulas (1) and and (4) may preferably be used as a charge transport material. The combination of such compounds is effective in improving resistances to abrasion, crack and crystallization of the resultant photosensitive layer.

6 Claims, 1 Drawing Sheet

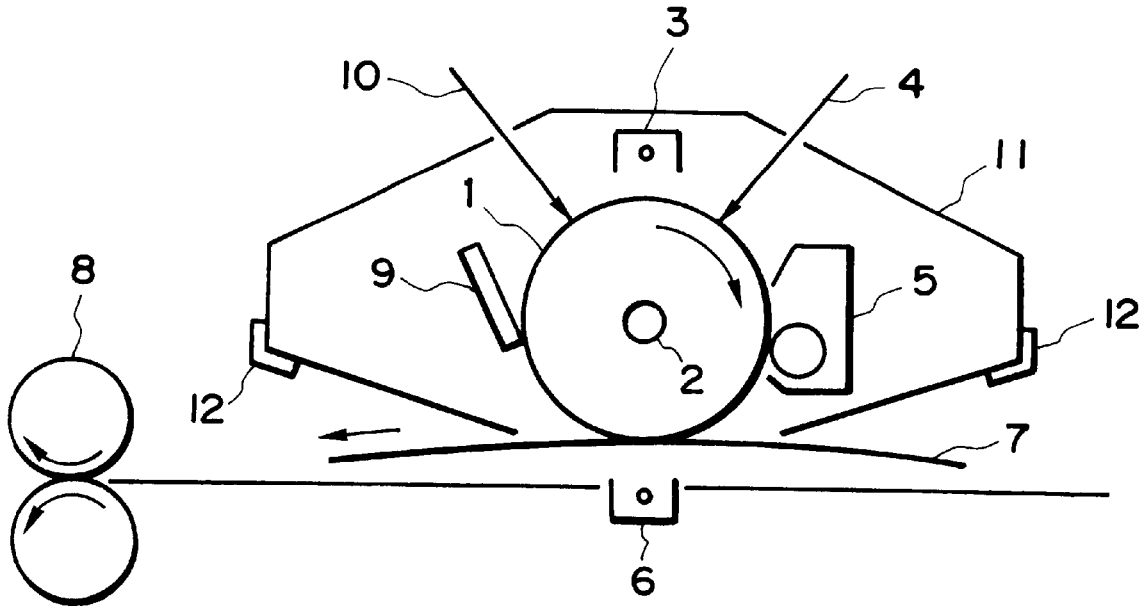
3
10
4
11
1
8
9
5
12
2
12
7
6

ELECTROPHOTOGRAPHIC PHOTOSENSITIVE MEMBER AND PROCESS CARTRIDGE AND ELECTROPHOTOGRAPHIC APPARATUS INCLUDING SAME

FIELD OF THE INVENTION AND RELATED ART

The present invention relates to an electrophotographic photosensitive member, particularly to an electrophotographic photosensitive member (hereinafter, sometimes referred to as "photosensitive member") improved in electrophotographic characteristics.

The present invention also relates to a process cartridge and an electrophotographic apparatus respectively using the electrophotographic photosensitive member.

In recent years, many organic photosensitive members using organic photoconductive materials having the advantages of high safety, excellent productivity and inexpensiveness have been extensively researched and developed, thus having been proposed and put into practical use.

For instance, there has been proposed an organic photosensitive member using a charge transfer complex, as a main component, containing an organic photoconductive material represented by poly-N-vinyl carbazole and 2,4,7-trinitro-9-fluorenone. However, the resultant photosensitive member has not been necessarily satisfactory in respect of a sensitivity, a durability, and a residual potential.

Further, there has also been proposed a photosensitive member having a laminate-type structure, wherein a photosensitive layer comprises a charge generation layer (CGL) containing a charge-generating material (CGM) and a charge transport layer (CTL) containing a charge-transporting material (CTM) (i.e., so-called "function-separation type photosensitive member"). Such a function-separation type photosensitive member has brought about a considerable improvement on a conventional photosensitive member possessing defects such as low sensitivity and poor durability.

The function-separation type photosensitive member allows a wide latitude in selecting a CGM and a CTM. As a result, it is possible to relatively readily prepare a photosensitive member having a desired characteristic.

As examples of the CGM, there have been known various materials such as azo pigments, polycyclic quinone pigments, phthalocyanine pigments, cyanine colorants, squaric acid dyes and pyrylium salt-type colorants.

Further, as examples of the CTM, there have been also known various materials including:

pyrazoline compounds as disclosed in Japanese Patent Publication (JP-B) No. 52-4188; hydrazone compounds as disclosed in JP-B 55-42380 and Japanese Laid-Open Patent Application (JP-A) No. 55-52063; triphenylamine compounds as disclosed in JP-B 58-32372, or JP-A 61-132955, JP-A 62-20854, JP-A 2-230255, JP-A 3-78756 and JP-A 7-72639; and a stilbene compound as disclosed in JP-A 54-151955 or JP-A 58-198043.

In recent years, however, further improvements in sensitivity and durability of the photosensitive member has been required along with demands for a high quality and a high durability.

Further, a printer, a copying machine and a facsimile machine including such a photosensitive member have recently been used in various fields and accordingly have been required to provide always stable images even on various environmental conditions.

In addition, in the case where a protective layer has been formed on a photosensitive layer (e.g., on a charge transport layer) or a photosensitive member has been kept or left staying within the copying machine or printer for a long period of time, a crack in the charge transport layer and/or a crystallization of a charge transport material has been liable to occur, thus leading to image defects which have recently been particularly noted.

SUMMARY OF THE INVENTION

An object of the present invention is to provide an electrophotographic photosensitive member having electrophotographic characteristics.

Another object of the present invention is to provide an electrophotographic photosensitive member excellent in a resistance to abrasion and an environmental stability.

A further object of the present invention is to provide an electrophotographic photosensitive member having excellent resistances to crack and crystallization.

A still further object of the present invention is to provide a process cartridge and an electrophotographic apparatus respectively including such a photosensitive member.

According to the present invention, there is provided an electrophotographic photosensitive member, comprising: a support and a photosensitive layer disposed on the support, wherein said photosensitive layer contains:

(i) a fluorene compound represented by a formula (1) shown below and an arylamine compound different from the fluorene compound of the formula (1) and represented by a formula (3) shown below, or (ii) a fluorene compound represented by a formula (1) shown below and a stilbene compound represented by a formula (4) shown below, (1)

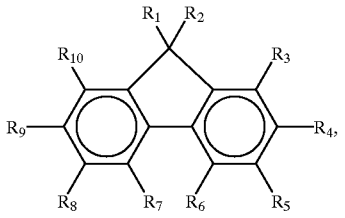

wherein $R_1$ and $R_2$ independently denote a substituted or unsubstituted alkyl group, a substituted or unsubstituted aryl group, or a substituted or unsubstituted aralkyl group, $R_1$ and $R_2$ being optionally connected with each other to form a ring structure; and $R_3$ to $R_{10}$ independently denote a substituted or unsubstituted diarylamino group, a substituted or unsubstituted alkyl group, a substituted or unsubstituted aryl group, a substituted or unsubstituted aralkyl group, halogen atom, nitro group or hydrogen atom, at least two of $R_3$ to $R_{10}$ being a substituted or unsubstituted diarylamino group;

(3)

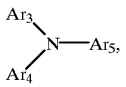

wherein $Ar_3$, $Ar_4$ and $Ar_5$ independently denote a substituted or unsubstituted aryl group or a substituted or unsubstituted heterocyclic group;

(4)

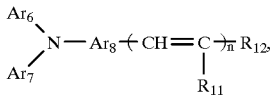

wherein $Ar_6$ and $Ar_7$ independently denote a substituted or unsubstituted aryl group or a substituted or unsubstituted heterocyclic group; $Ar_8$ denotes a substituted or unsubstituted arylene group or a substituted or unsubstituted divalent heterocyclic group; $R_{11}$ and $R_{12}$ independently denote a substituted or unsubstituted alkyl group, a substituted or unsubstituted aryl group, a substituted or unsubstituted heterocyclic group or hydrogen atom, $R_{11}$ and $R_{12}$ being optionally connected with each other to form a ring structure when n is 1; and n is 1 or 2.

According to the present invention, there is also provided a process cartridge and an electrophotographic apparatus including the above-mentioned electrophotographic photosensitive member.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE is a schematic sectional view of an embodiment of an electrophotographic apparatus including a process cartridge using an electrophotographic photosensitive member according to the present invention.

DETAILED DESCRIPTION OF THE INVENTION

The electrophotographic photosensitive member according to the present invention is characterized by: a photosensitive layer comprising a combination (i) of a fluorene compound represented by the above-mentioned formula (1) and an arylamine compound represented by the above-mentioned formula (3) different from the fluorene compound of the formula (1) or a combination (ii) of the fluorene compound represented by the above-mentioned formula (1) and a stilbene compound represented by the above-mentioned formula (4).

In the above-mentioned formula (1), $R_1$ to $R_{10}$ may include: alkyl group, such as methyl, ethyl, propyl and butyl; aryl group, such as phenyl, naphthyl and pyrenyl; aralkyl group, such as benzyl, phenethyl and naphthylmethyl.

$R_1$ and $R_2$ in the formula (1) may be connected with each other to form a ring structure, such as cyclopentane ring or cyclohexane ring.

$R_3$ to $R_{10}$ in the formula (1) include at least two substituted or unsubstituted diarylamino group as described above. Each diarylamino group may preferably be represented by the following formula (2):

(2)

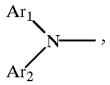

wherein $Ar_1$ and $Ar_2$ independently denote a substituted or unsubstituted aryl group or a substituted or unsubstituted heterocyclic group. Examples of such a diarylamino group may include diphenylamino group and dinaphthylamino group.

Examples of halogen atom for $R_3$ to $R_1$ in the formula (1) may include fluorine atom, chlorine atom, bromine atom and iodine atom.

In the formula (2) described above, $Ar_1$ and $Ar_2$ may include aryl group, such as phenyl, naphthyl, anthryl and pyrenyl; and heterocyclic group, such as pyridyl, thienyl and furyl.

In the formula (3), $Ar_3$, $Ar_4$ and $Ar_5$ may include aryl group, such as phenyl, naphthyl, anthryl, pyrenyl and fluorenyl; and heterocyclic group, such as pyridyl, thienyl, furyl and quinolyl.

In the formula (4), $Ar_6$, $Ar_7$, $R_{11}$ and $R_{12}$ may include aryl group, such as phenyl, naphthyl, anthryl an pyrenyl; and heterocyclic group, such as pyridyl, thienyl, furyl and quinolyl. $R_{11}$ and $R_{12}$ in the formula (4) may include alkyl group, such as methyl, ethyl, propyl and butyl. Further, $R_{11}$ and $R_{12}$ may be connected with each other to form a ring structure, such as indene, 5H-dibenzo[a,d]cycloheptene and 10,11-dihydro-5H-dibenzo[a,d]cycloheptene, when n in the formula (4) is 1. $Ar_8$ in the formula (4) may include arylene group, such as phenylene and naphthylene and a divalent heterocyclic group, such as pyridine-diyl, thiophene-diyl, furan-diyl and quinoline-diyl.

$R_1$ to $R_{12}$ and $Ar_1$ to $Ar_8$ in the formulas (1) to (4) may each have a substituent as described above. Examples of such a substituent may include: alkyl group such as methyl, ethyl, propyl or butyl; aralkyl group such as benzyl, phenethyl or naphthylmethyl; aryl group such as phenyl, naphthyl, anthryl, pyrenyl fluorenyl or carbazolyl; heretocyclic group such as pyridyl, thienyl, quinolyl or furyl; alkoxy group such as methoxy, ethoxy or propoxy; aryloxy group such as phenoxy or naphthoxy; halogen atom such as fluorine, chlorine, bromine or iodine; nitro group; cyano group; hydroxyl group.

In the present invention, the photosensitive layer may preferably contain the fluorene compound of the formula (1), and the arylamine compound of the formula (3) or the stilbene compound of the formula (4) in a weight ratio (compound (1): compound (3) or (4)) of 9:1 to 1:9, more preferably 9:1 to 3:2.

In a preferred embodiment of the present invention, at least two groups including $R_4$ and $R_9$ of the groups $R_3$ to $R_{10}$ in the formula (1) for the fluorene compound may be substituted or unsubstituted diarylamino group. Further, $Ar_3$, $Ar_4$ and $Ar_5$ in the formula (3) for the arylamine compound may preferably include one or two substituted or unsubstituted fluorenyl groups, more preferably one substituted or unsubstituted fluorenyl group.

In the present invention, the use of the arylamine compound of the formula (3) is particularly effective in improving an abrasion resistance of the resultant photosensitive member, and the use of stilbene compound of the formula (4) is particularly effective in improving an environmental stability, a resistance to crack and a resistance to crystallization with respect to the resultant photosensitive member.

Hereinbelow, specific and non-exhaustive preferred examples of the above-mentioned compounds represented by the formulas (1), (3) and (4) may include those shown by the following structural formulas.

In the following formulas, Example Compounds Nos. (1)-1 to (1)-86 represent the fluorene compound of the formula (1), those ((3)-1 to (3)-145) represent the arylamine compound of the formula (3), and those ((4)-1 to (4)-50) represent the stilbene compound of the formula (4).

Fluorene compound (1)
(1)-1
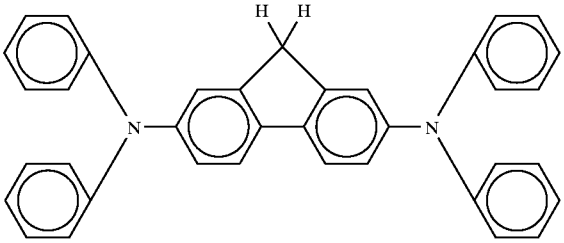
(1)-2
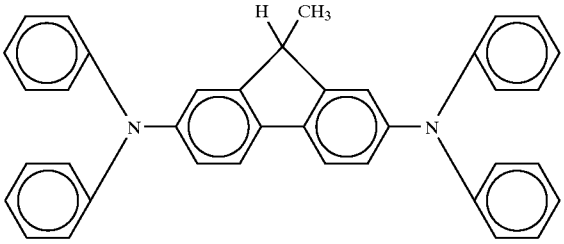
(1)-3
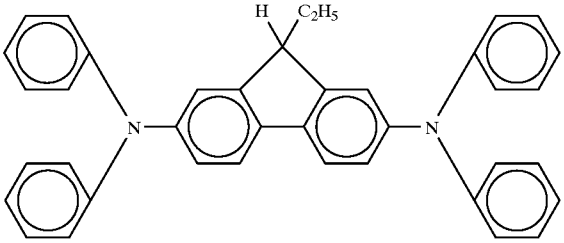
(1)-4
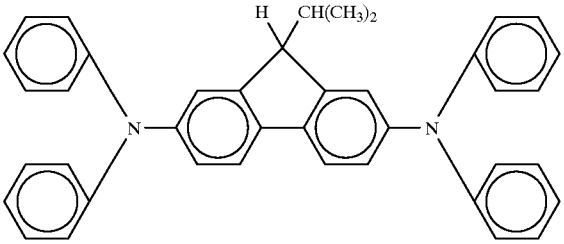
(1)-5
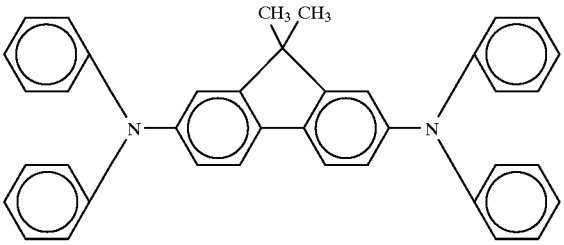
(1)-6
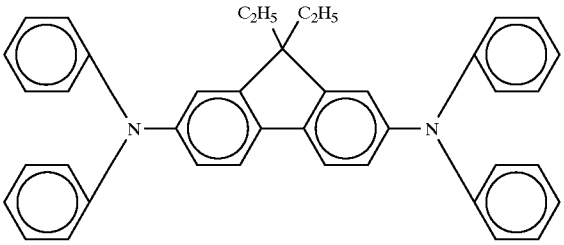

-continued
(1)-7
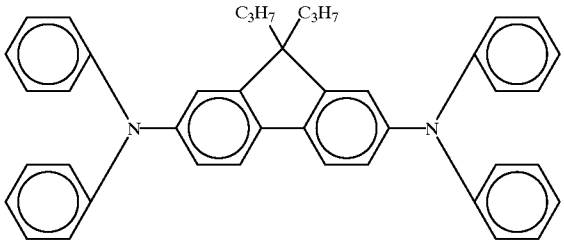
(1)-8
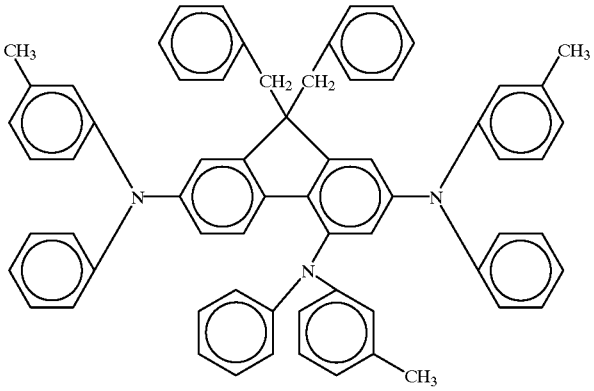
(1)-9
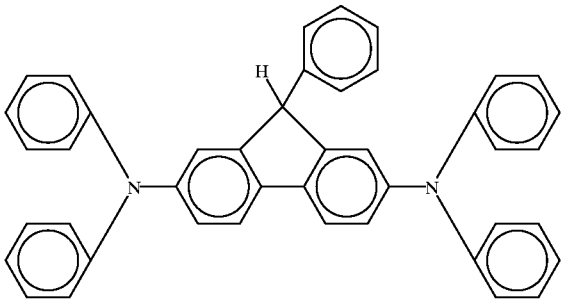
(1)-10
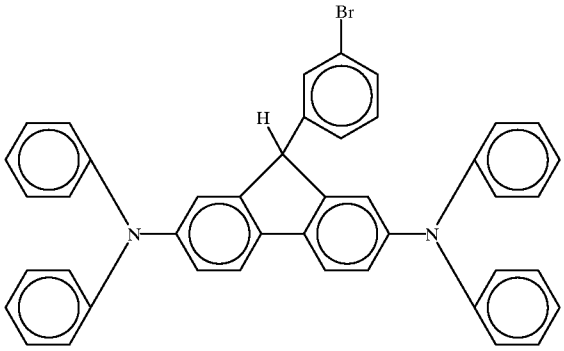

-continued
(1)-11
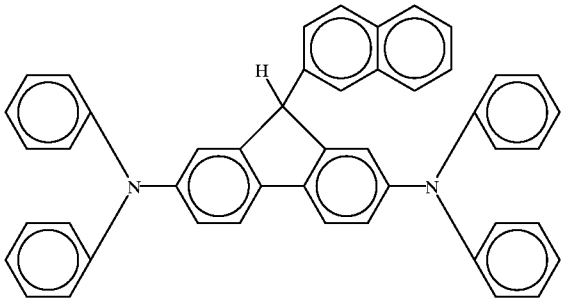
(1)-12
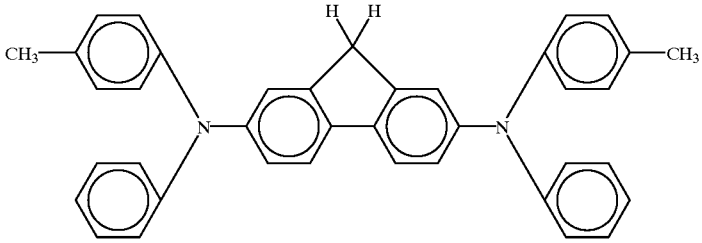
(1)-13
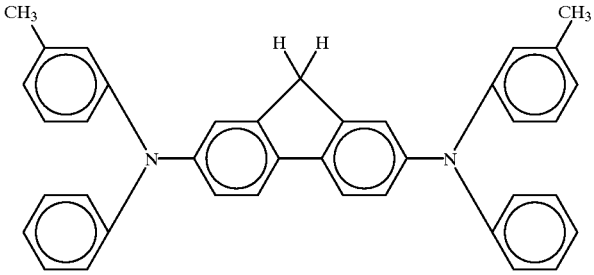
(1)-14
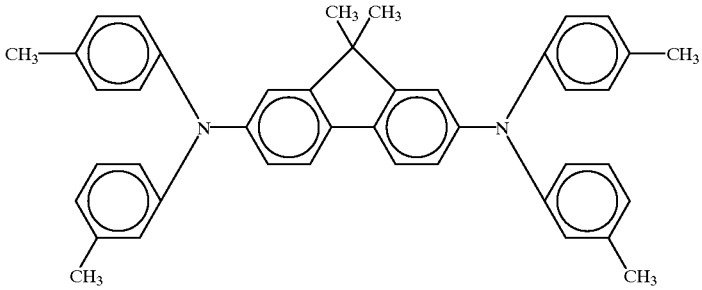
(1)-15
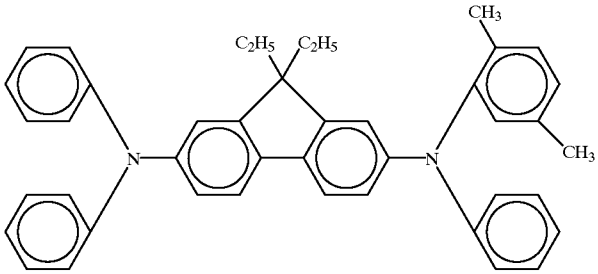

-continued
(1)-16
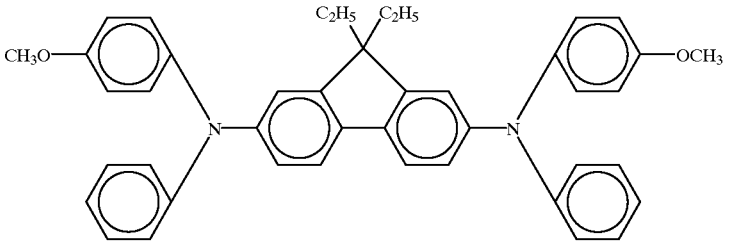
(1)-17
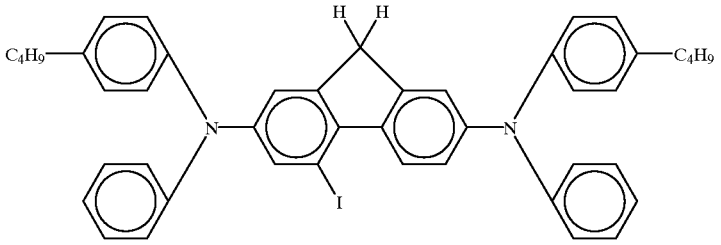
(1)-18
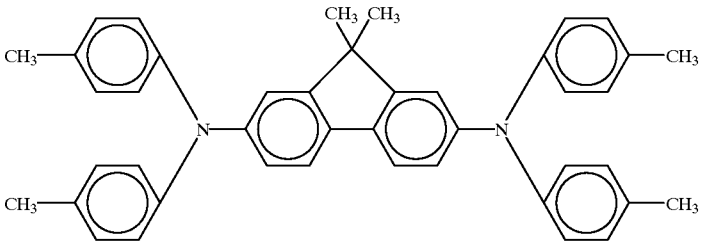
(1)-19
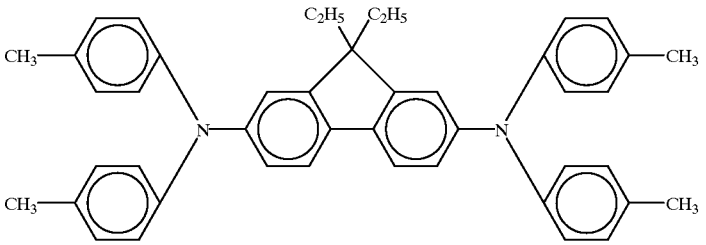
(1)-20
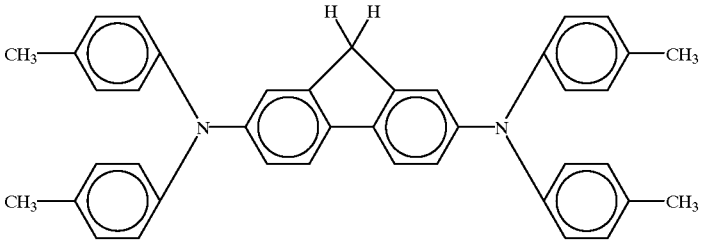

-continued
(1)-21
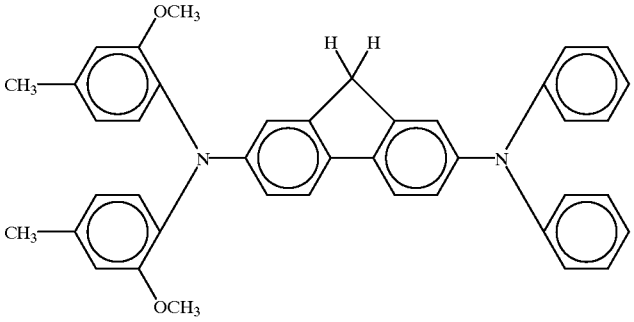
(1)-22
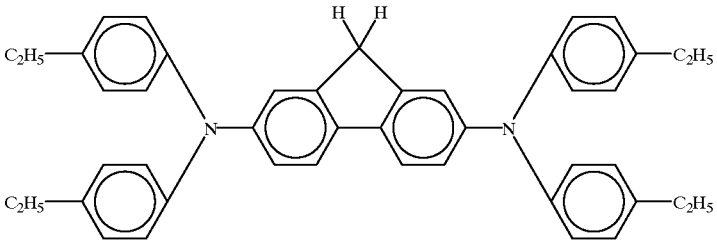
(1)-23
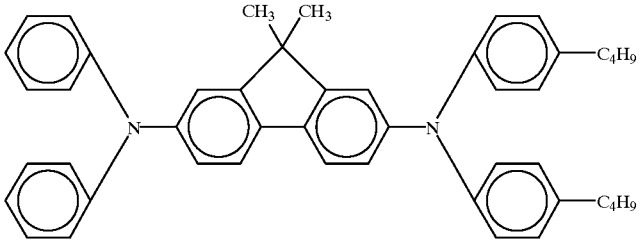
(1)-24
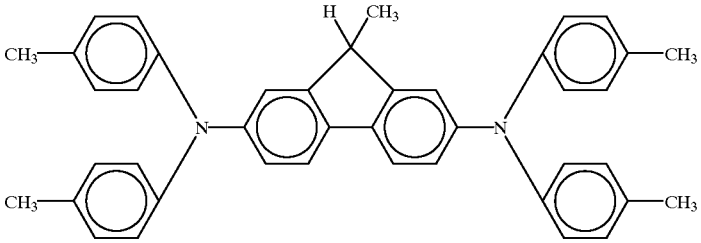
(1)-25
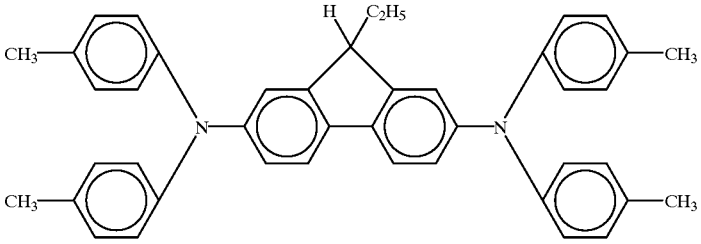

-continued
(1)-26
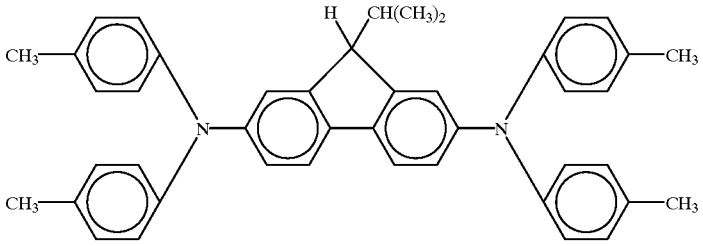
(1)-27
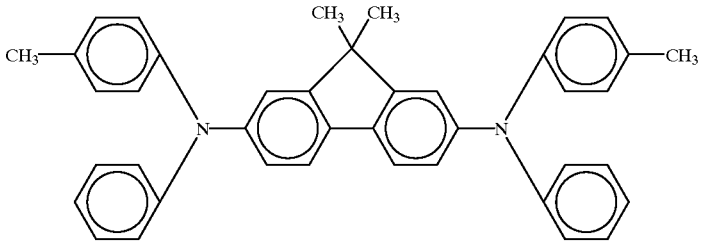
(1)-28
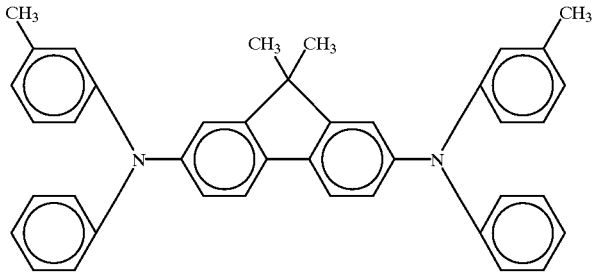
(1)-29
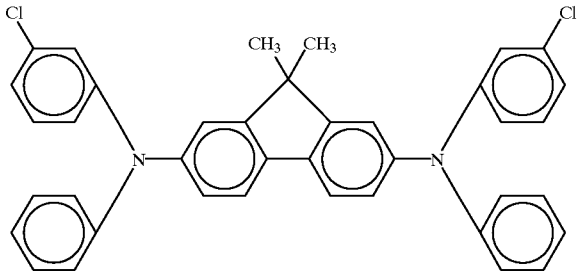
(1)-30
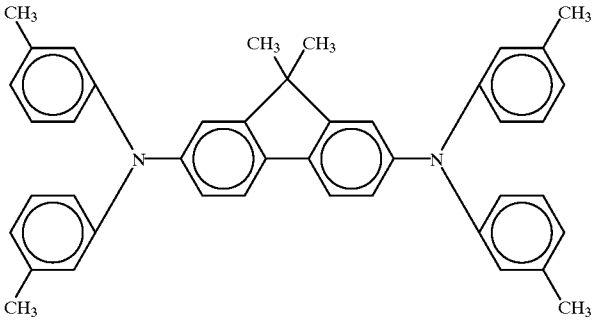

-continued
(1)-31
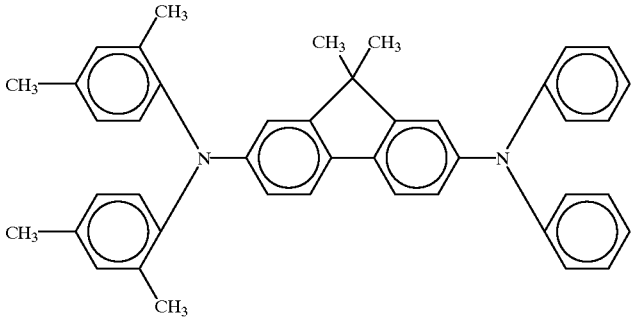
(1)-32
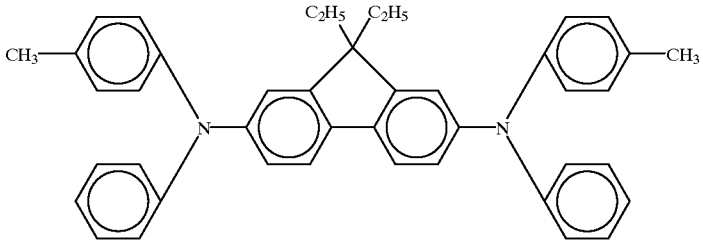
(1)-33
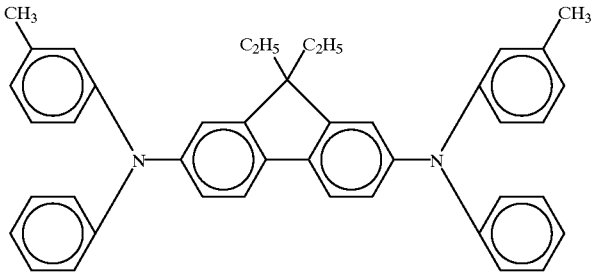
(1)-34
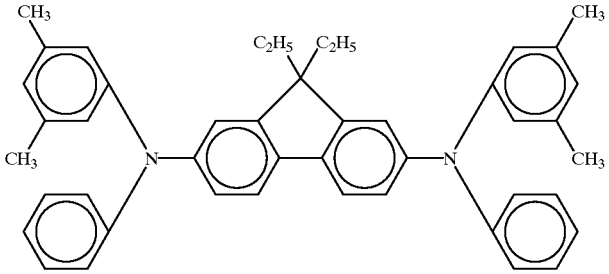
(1)-35
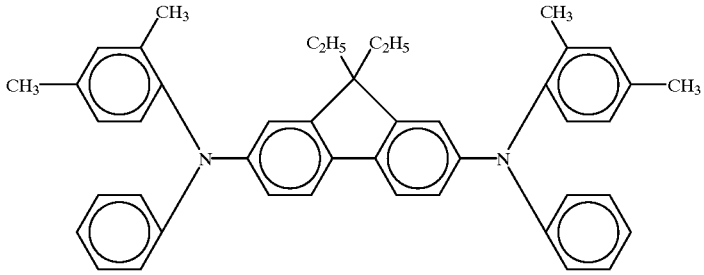

-continued
(1)-36
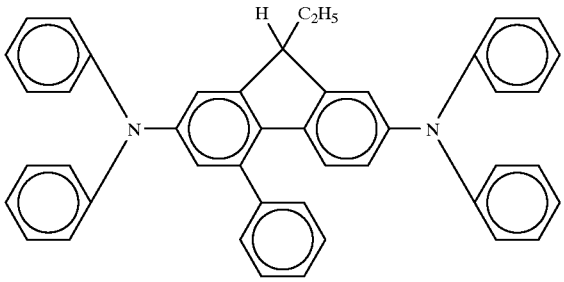
(1)-37
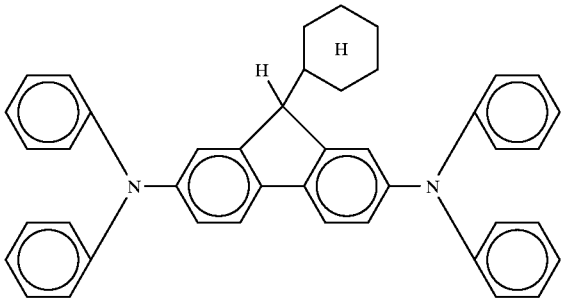
(1)-38
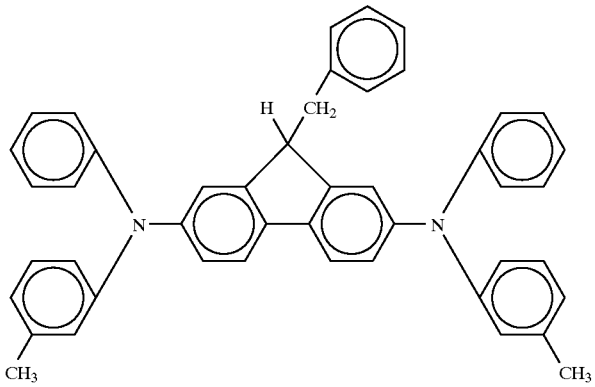
(1)-39
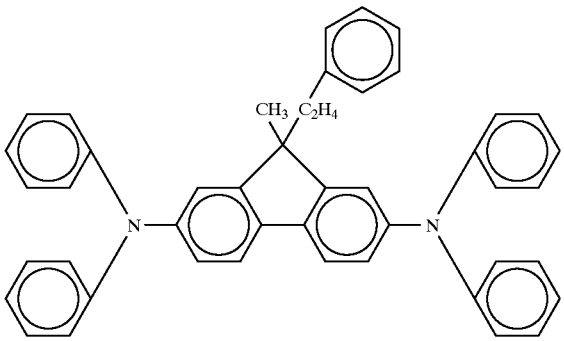

-continued
(1)-40
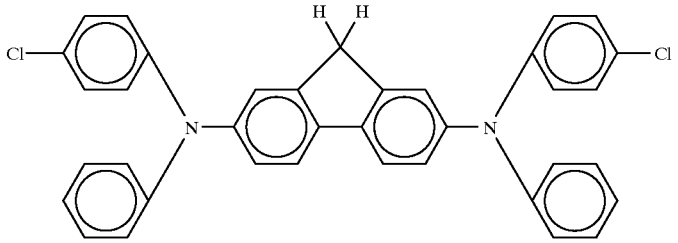
(1)-41
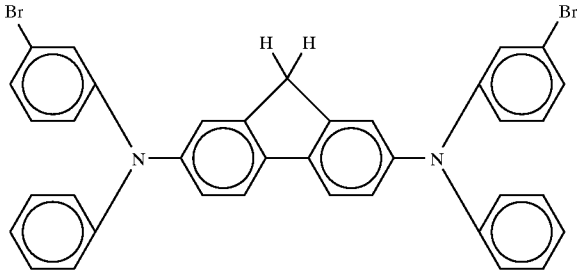
(1)-42
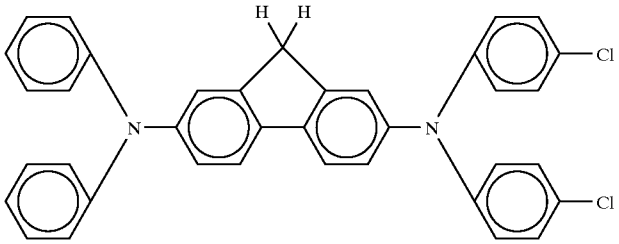
(1)-43
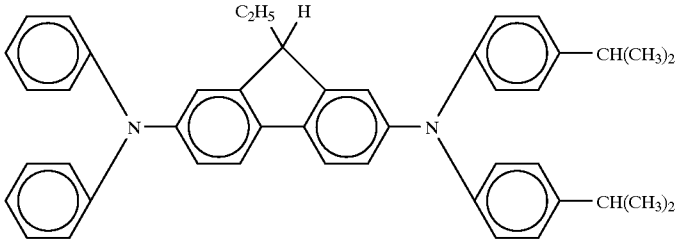
(1)-44
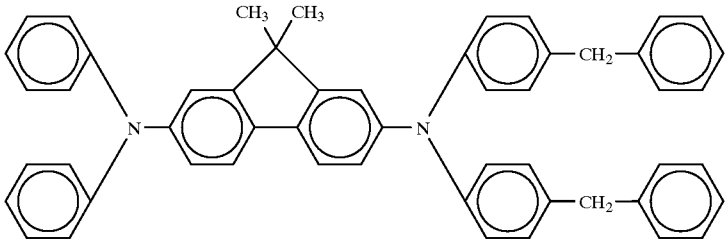
(1)-45
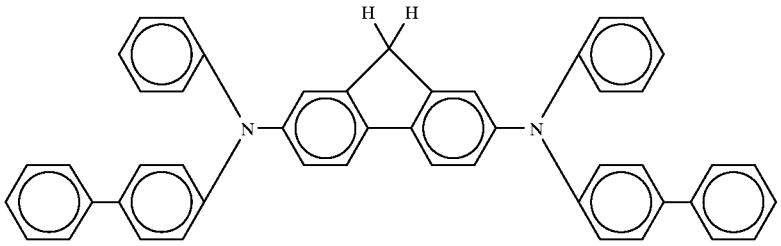

-continued
(1)-46
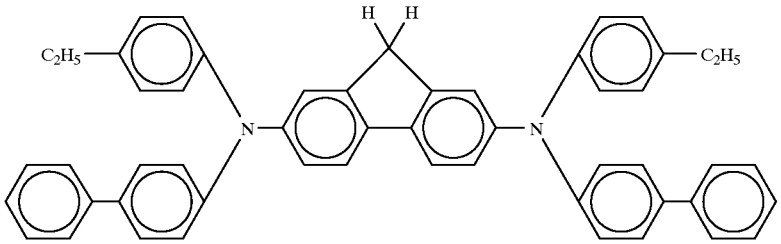
(1)-47
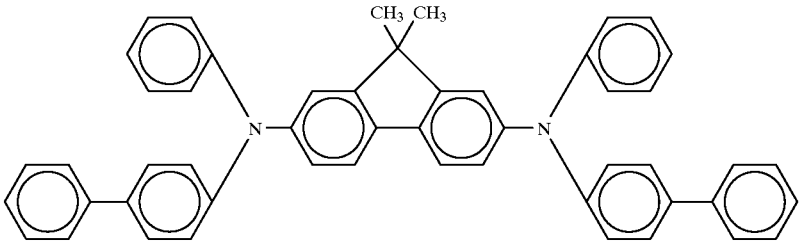
(1)-48
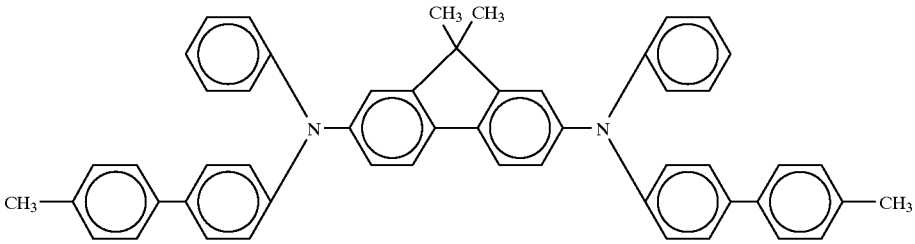
(1)-49
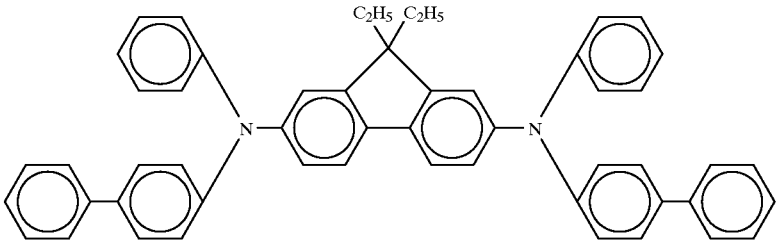
(1)-50
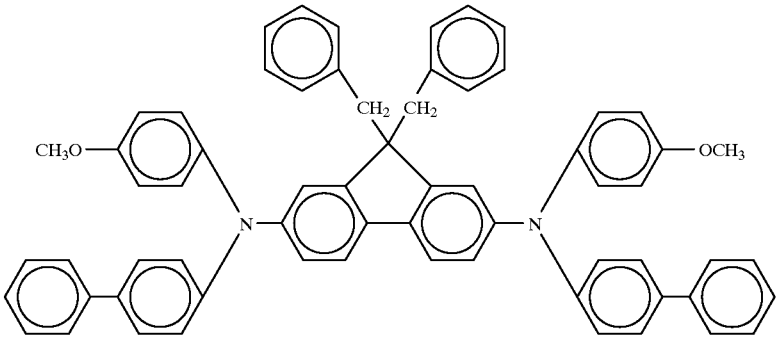

-continued
(1)-51
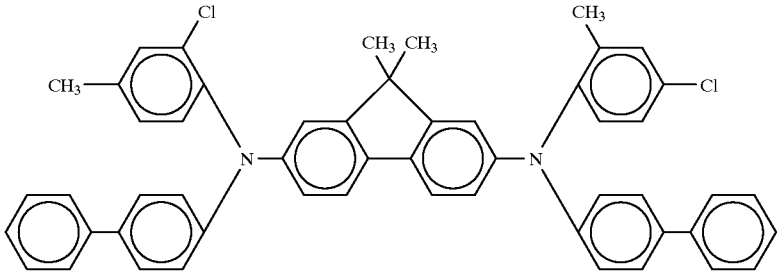
(1)-52
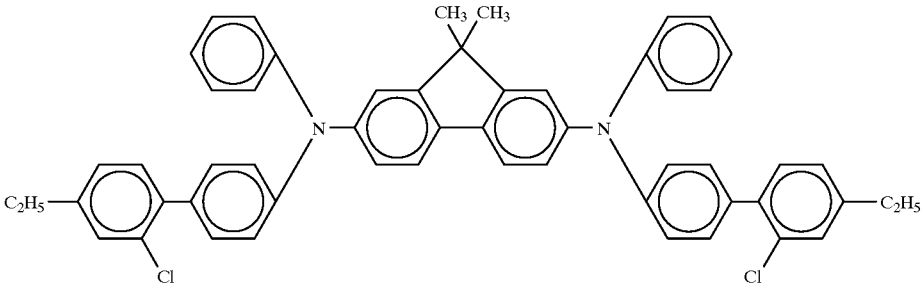
(1)-53
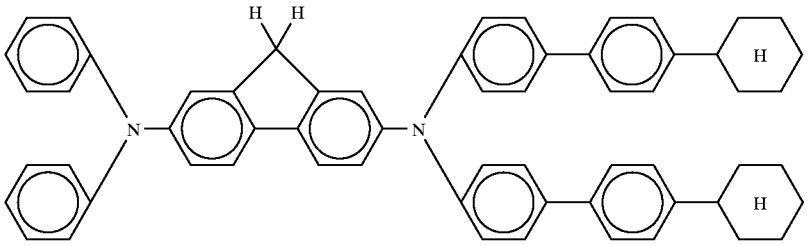
(1)-54
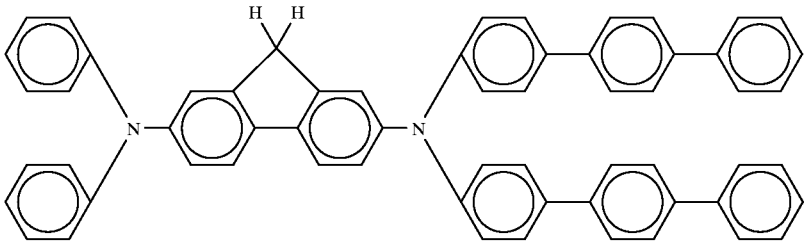
(1)-55
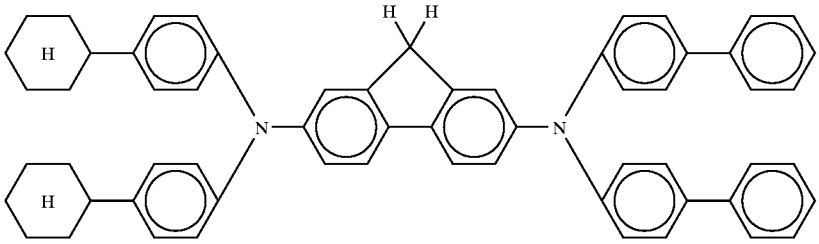

-continued
(1)-56
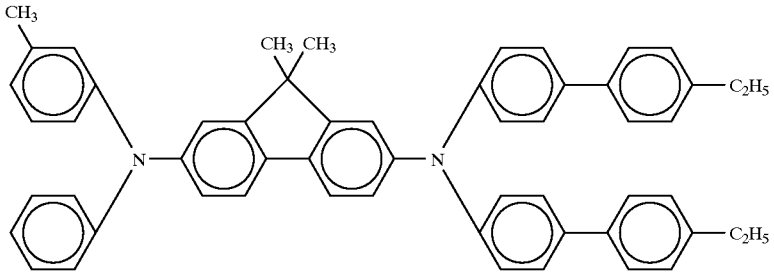
(1)-57
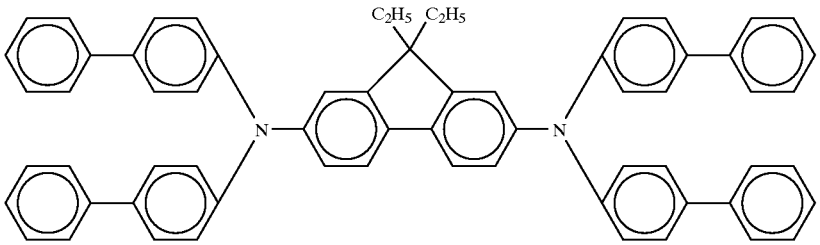
(1)-58
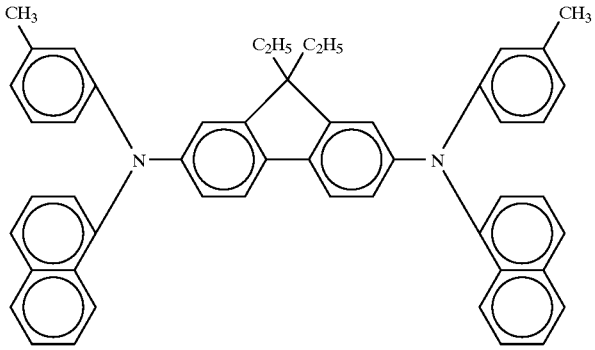
(1)-59
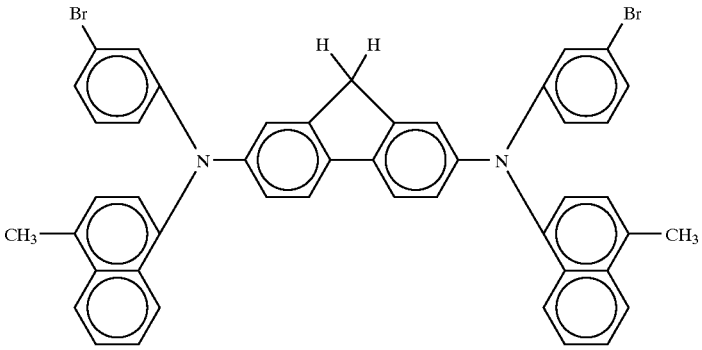

-continued
(1)-60
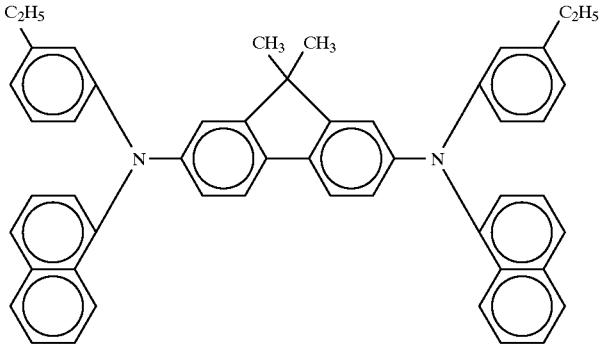
(1)-61
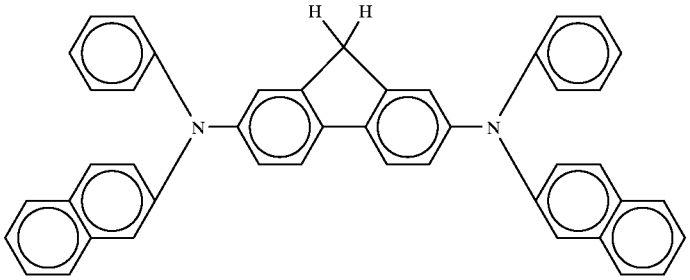
(1)-62
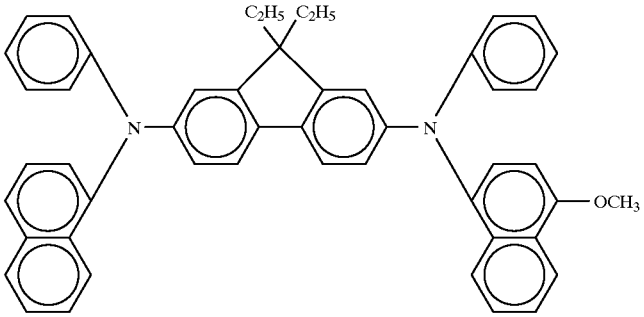
(1)-63
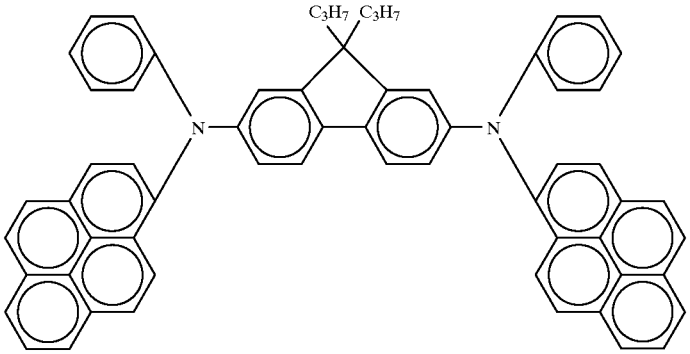

-continued
(1)-64
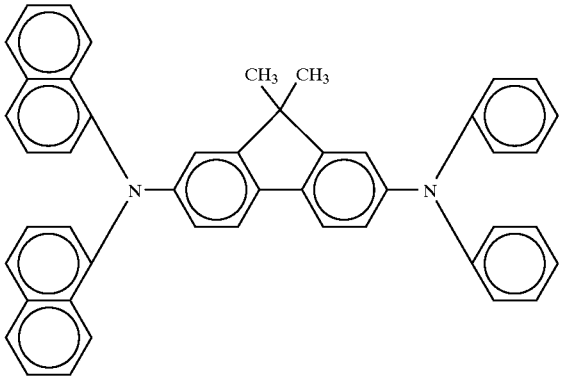
(1)-65
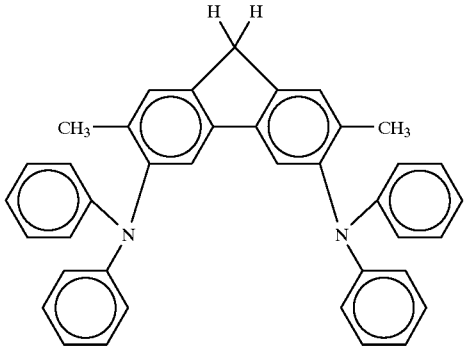
(1)-66
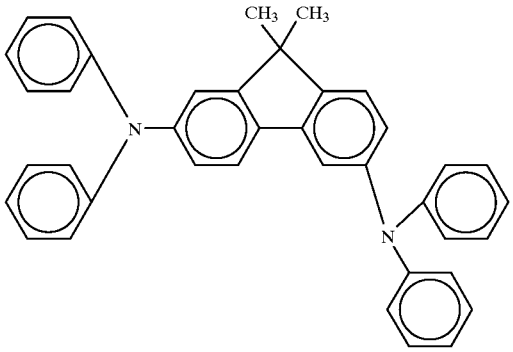
(1)-67
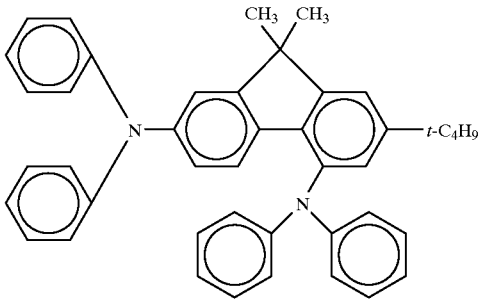

-continued
(1)-68
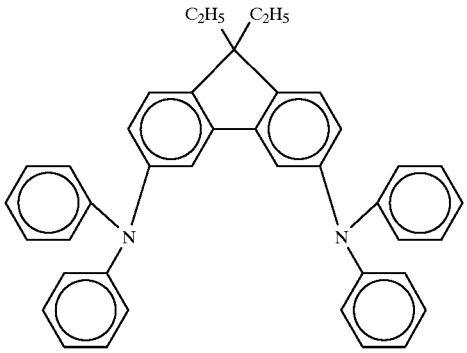
(1)-69
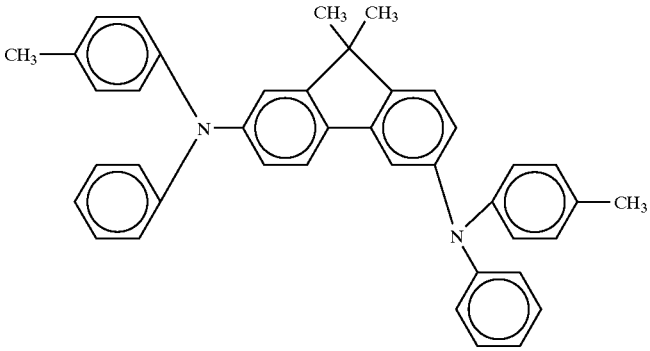
(1)-70
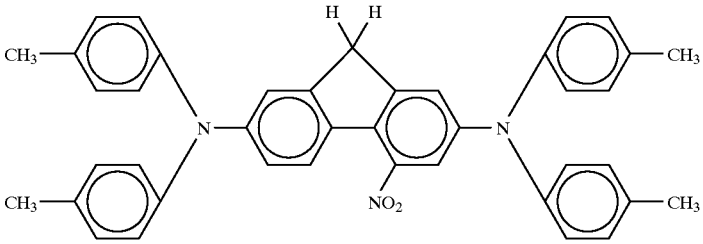
(1)-71
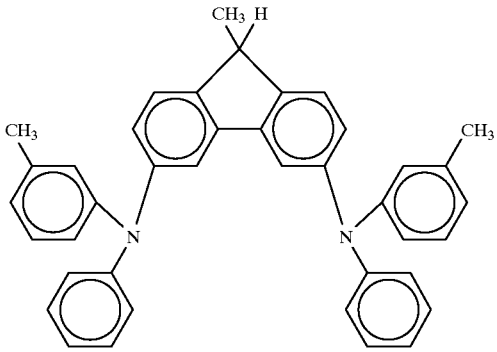

-continued
(1)-72
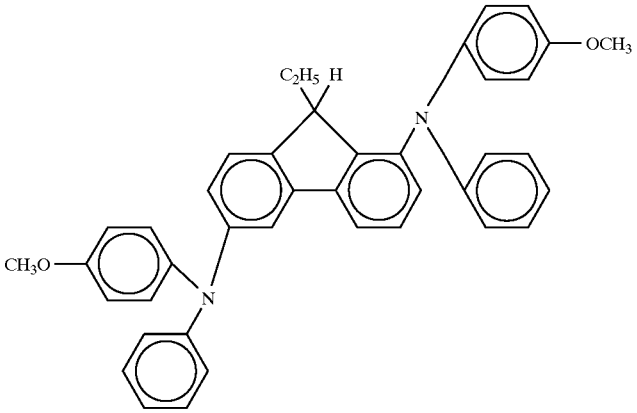
(1)-73
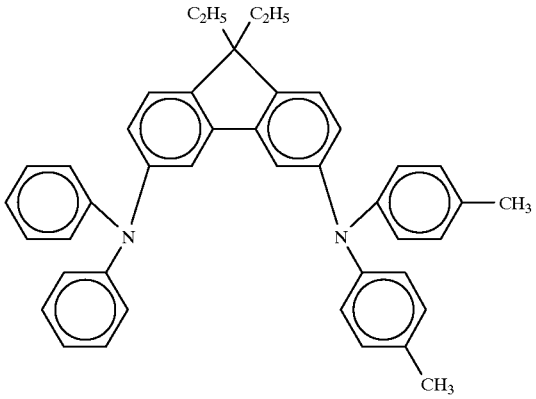
(1)-74
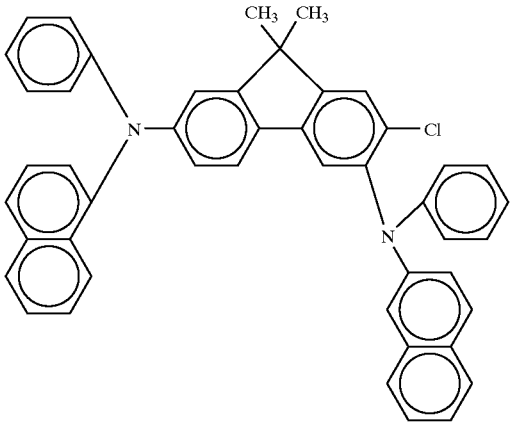

-continued
(1)-75
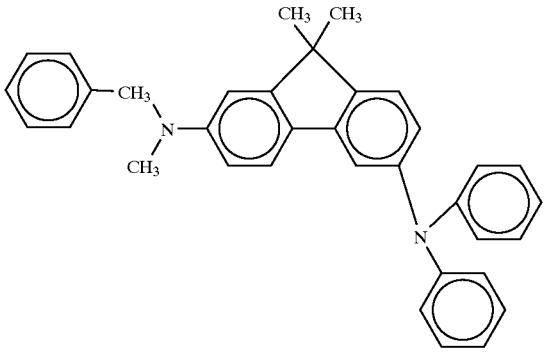
(1)-76
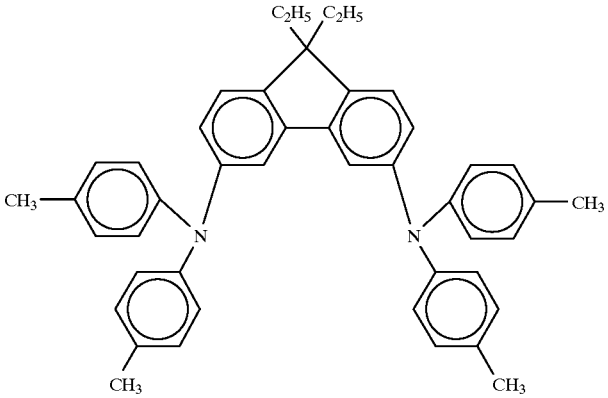
(1)-77
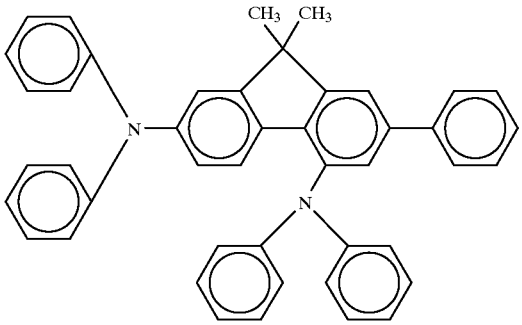
(1)-78
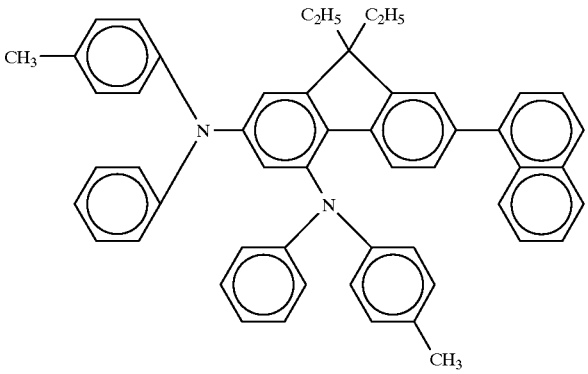

-continued
(1)-79
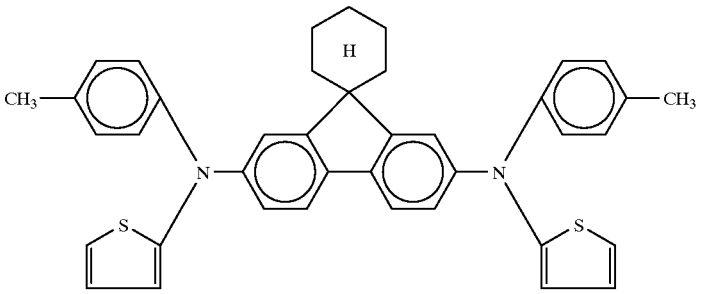
(1)-80
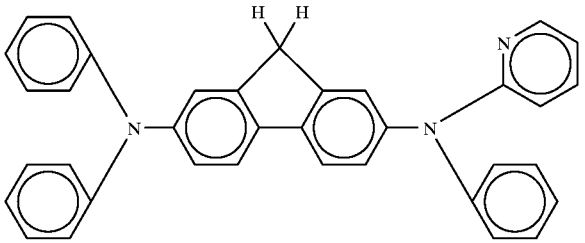
(1)-81
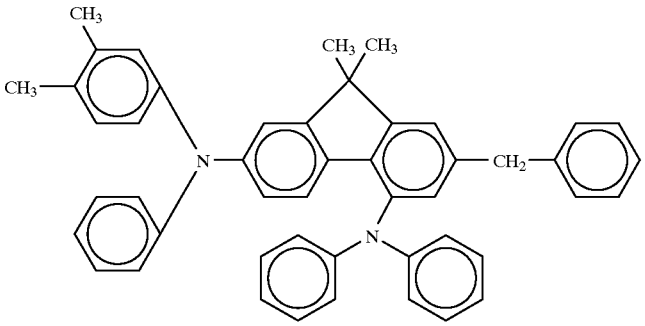
(1)-82
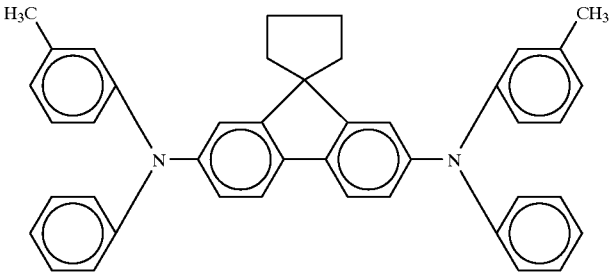
(1)-83
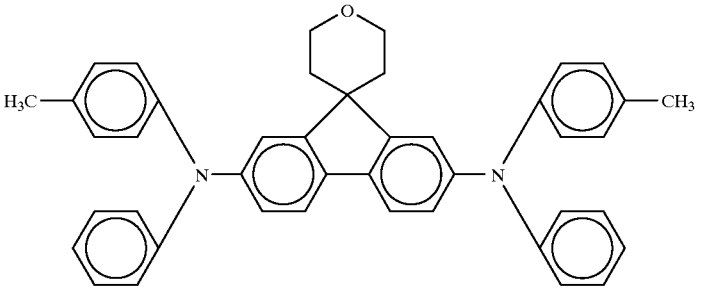

-continued
(1)-84
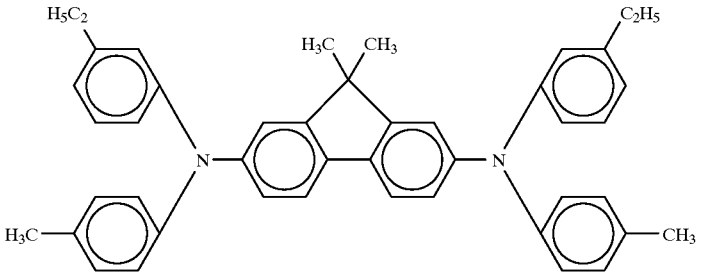
(1)-85
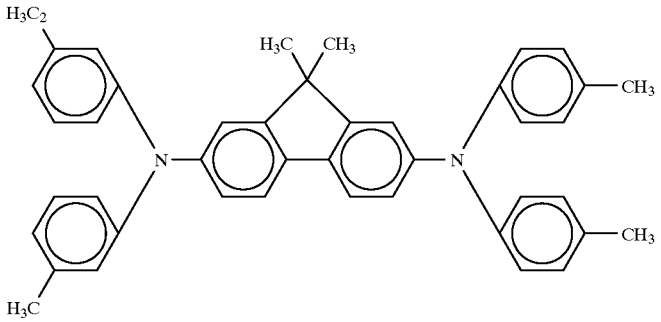
(1)-86
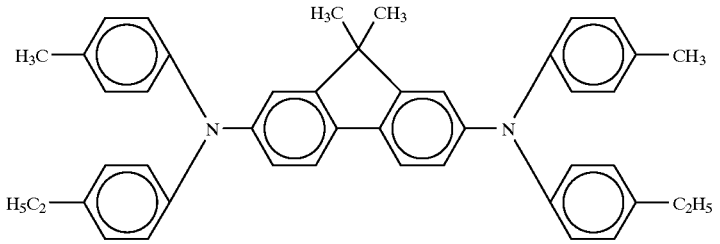
Arylamine compound (3)
(3)-1
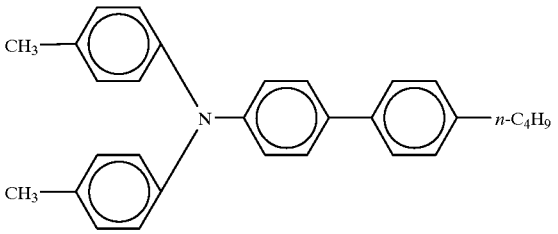
(3)-2
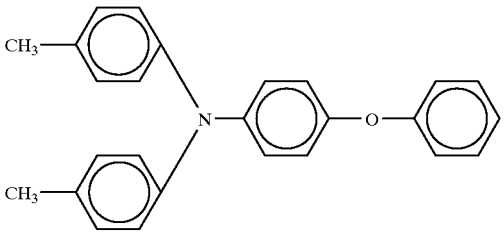

-continued
(3)-3
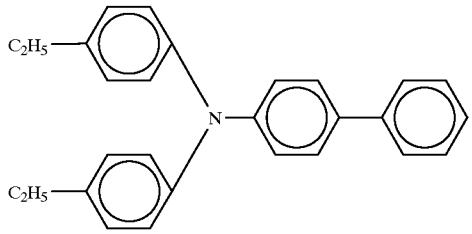
(3)-4
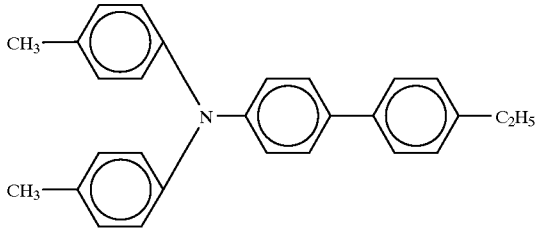
(3)-5
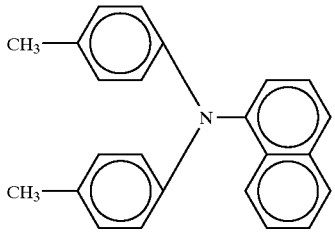
(3)-6
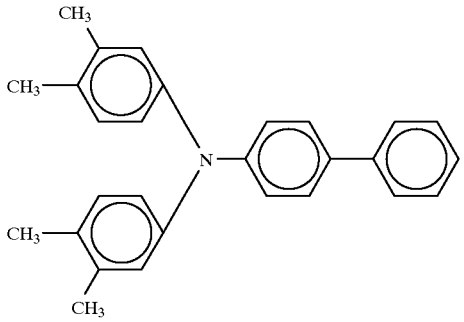
(3)-7
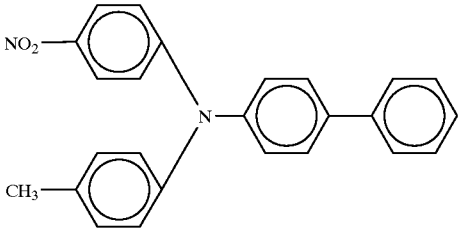

-continued
(3)-8
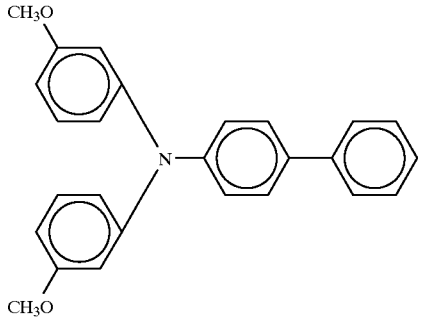
(3)-9
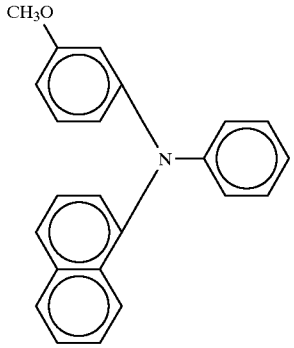
(3)-10
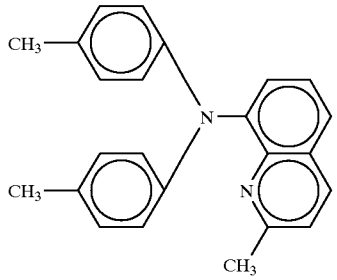
(3)-11
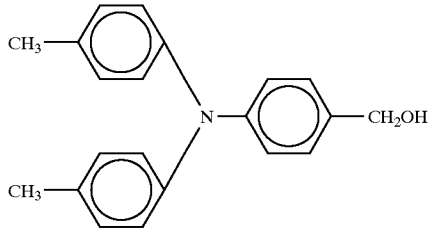
(3)-12
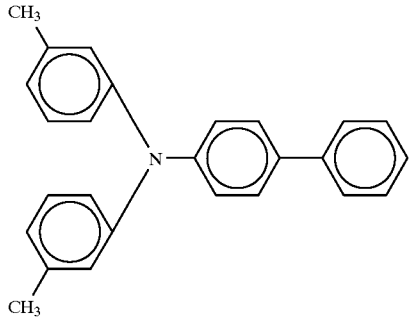

-continued
(3)-13
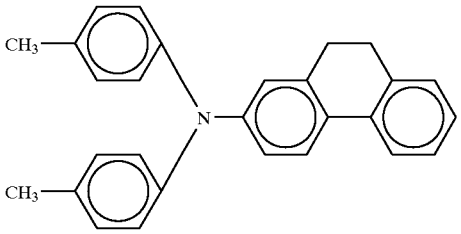
(3)-14
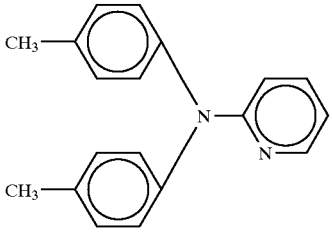
(3)-15
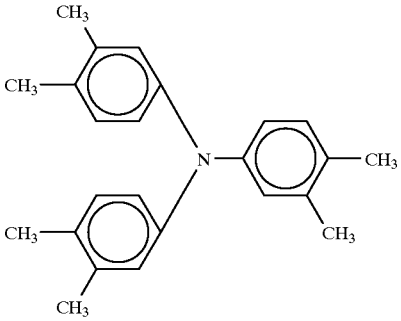
(3)-16
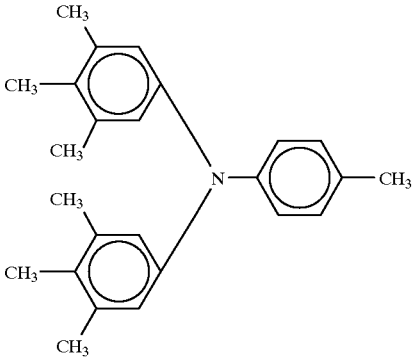
(3)-17
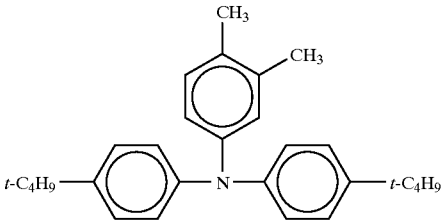

-continued
(3)-18
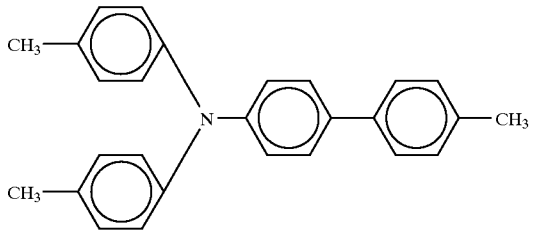
(3)-19
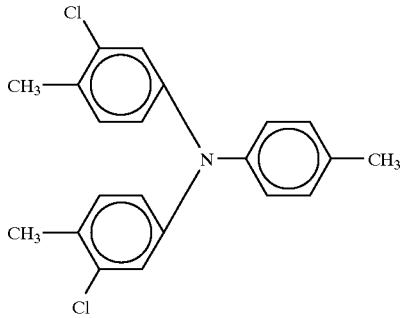
(3)-20
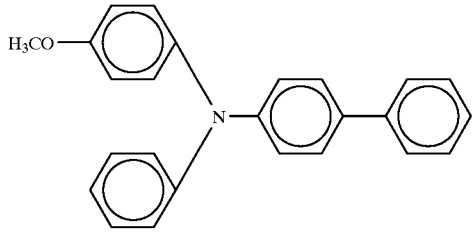
(3)-21
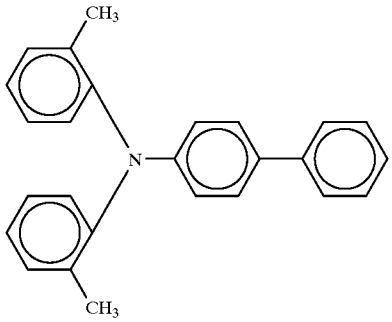
(3)-22
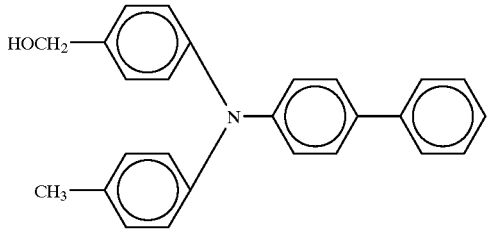

-continued
(3)-23
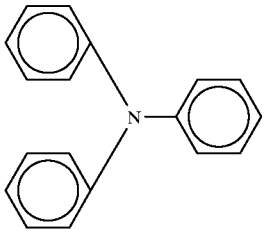
(3)-24
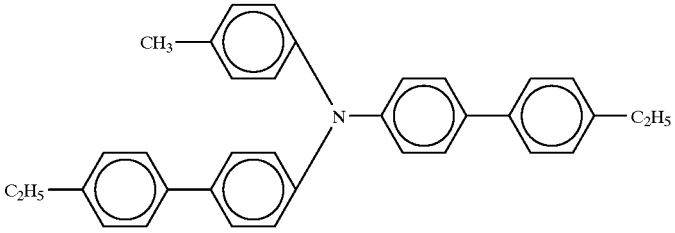
(3)-25
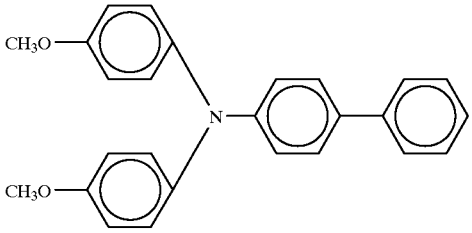
(3)-26
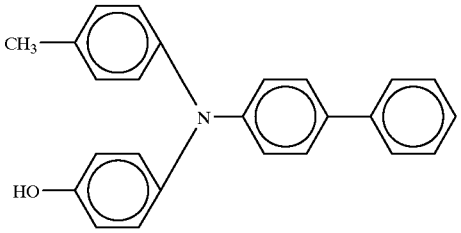
(3)-27
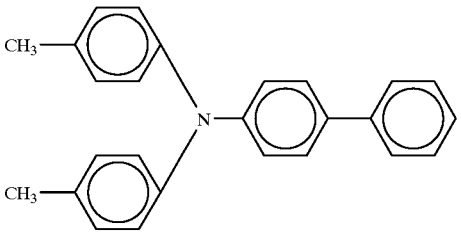

-continued
(3)-28
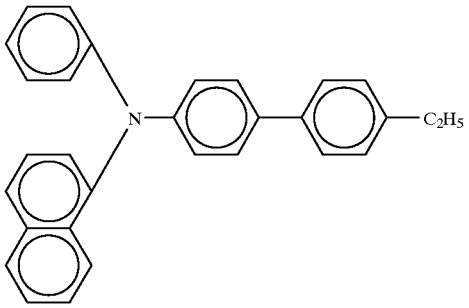
(3)-29
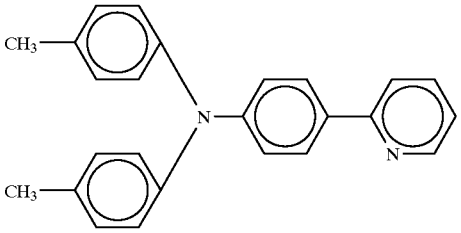
(3)-30
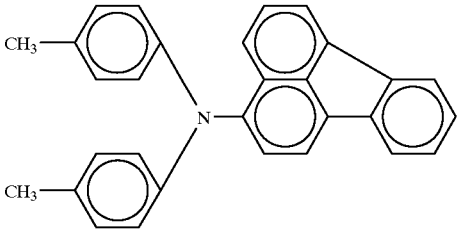
(3)-31
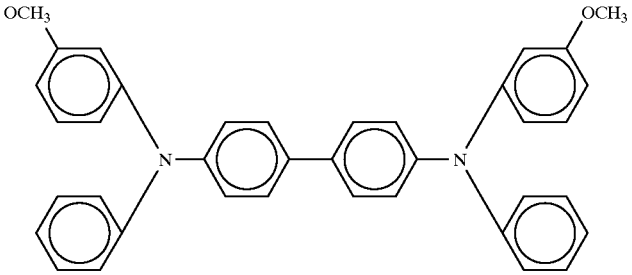
(3)-32
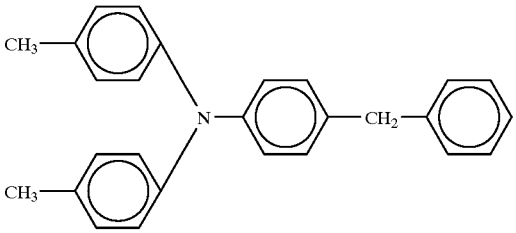

-continued
(3)-33
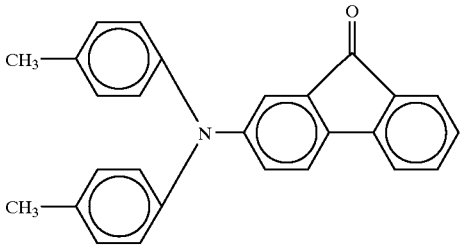
(3)-34
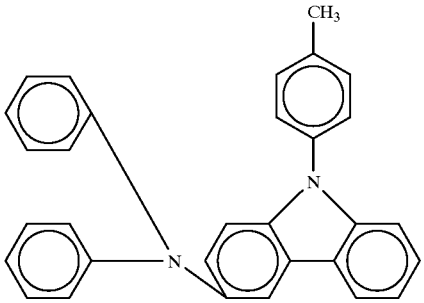
(3)-35
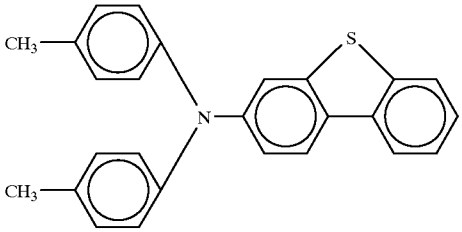
(3)-36
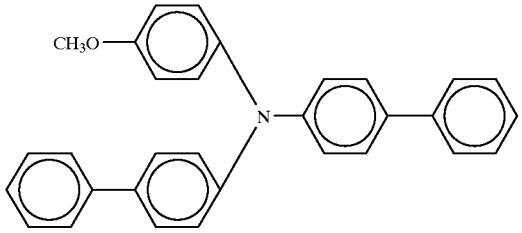
(3)-37
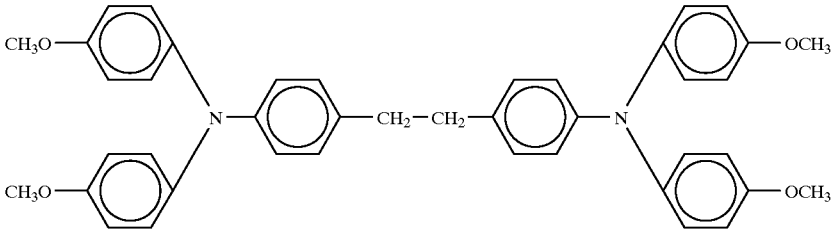

-continued
(3)-38
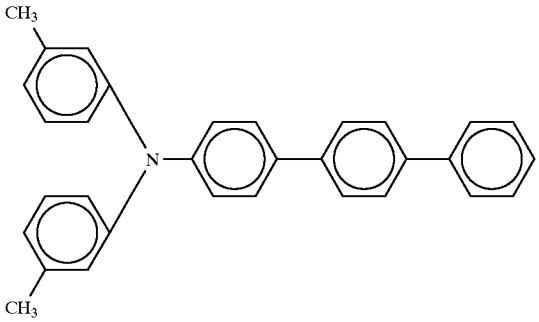
(3)-39
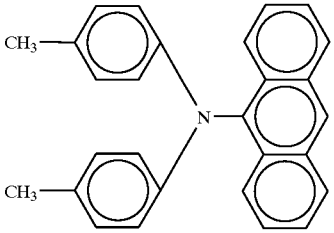
(3)-40
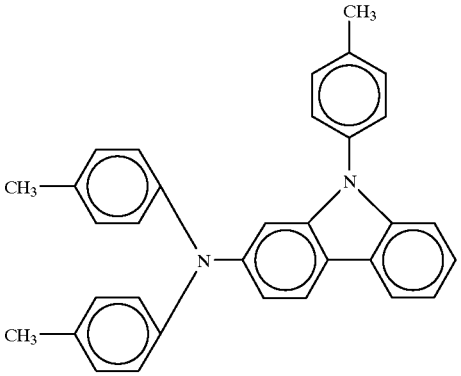
(3)-41
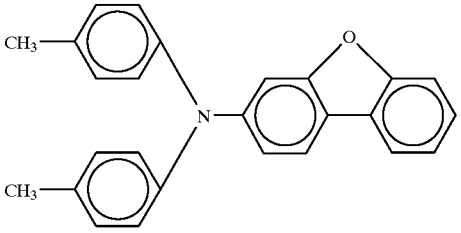
(3)-42
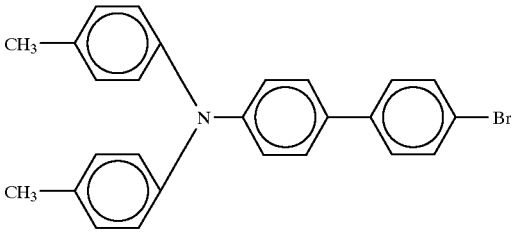

-continued
(3)-43
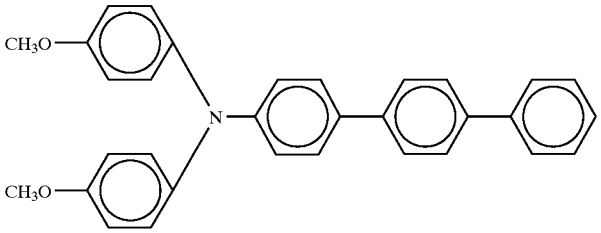
(3)-44
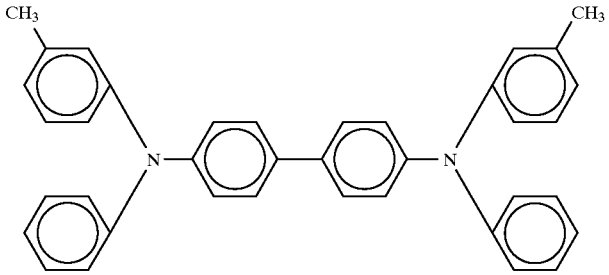
(3)-45
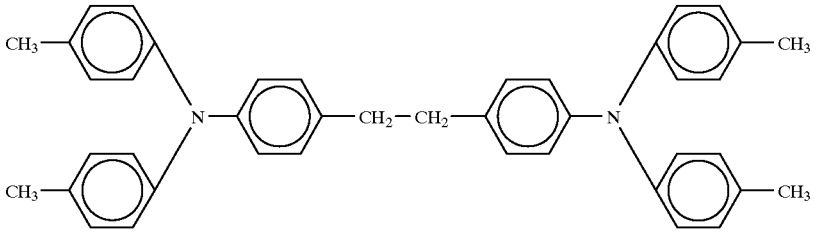
(3)-46
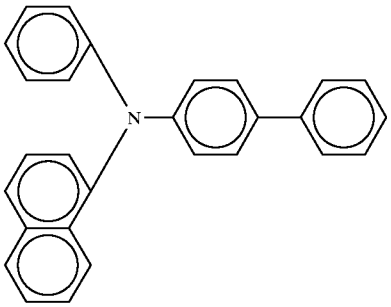
(3)-47
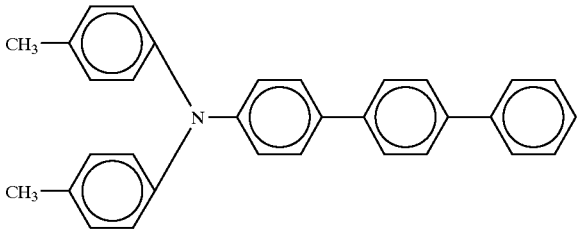

-continued
(3)-48
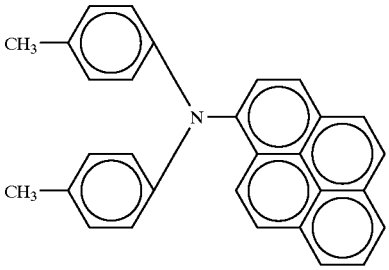
(3)-49
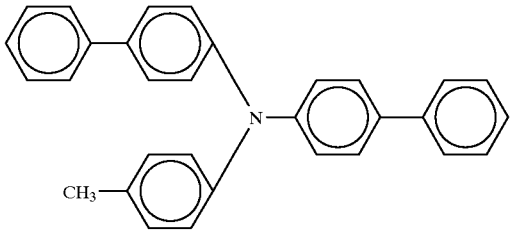
(3)-50
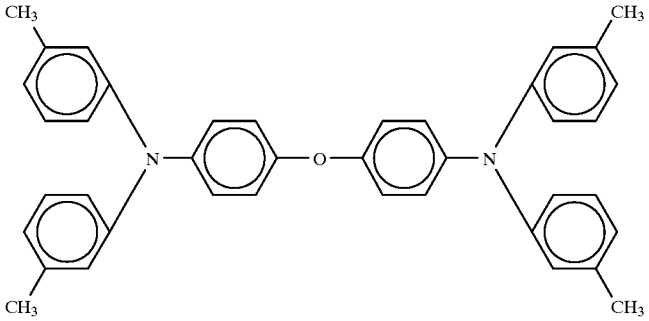
(3)-51
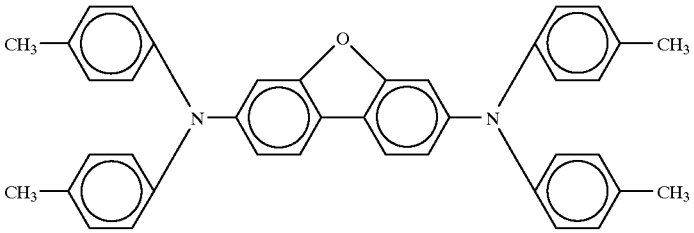
(3)-52
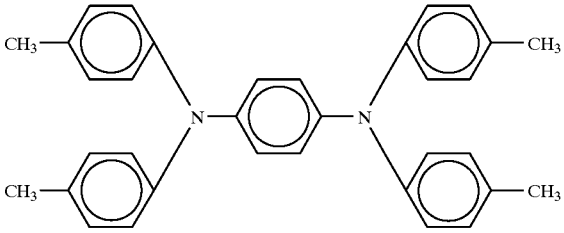

-continued
(3)-53
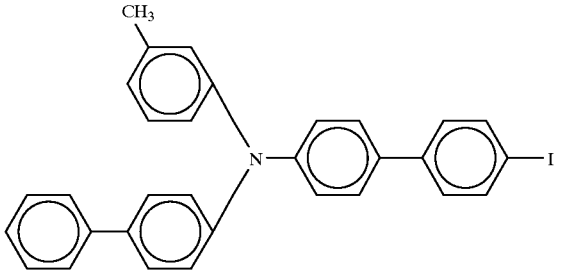
(3)-54
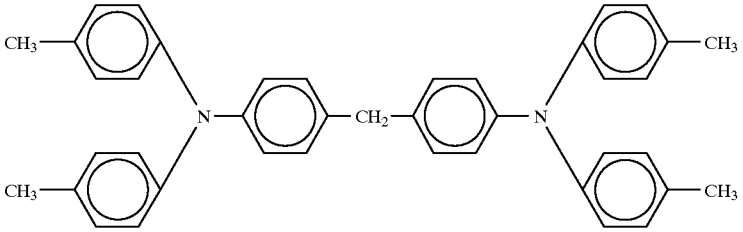
(3)-55
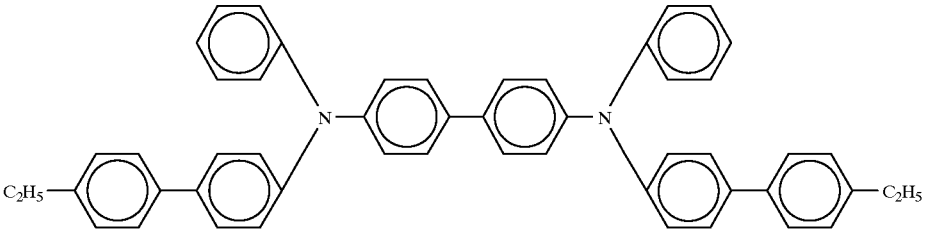
(3)-56
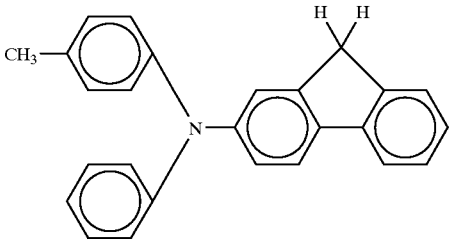
(3)-57
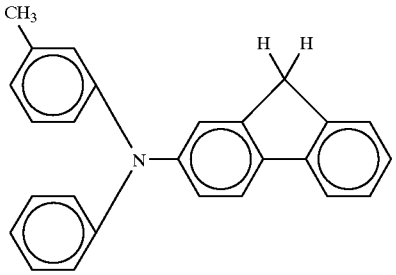

-continued
(3)-58
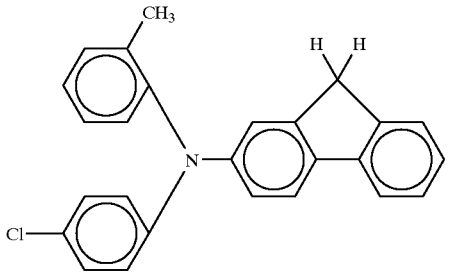
(3)-59
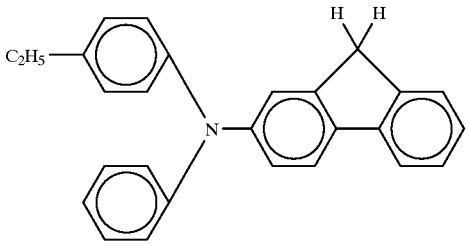
(3)-60
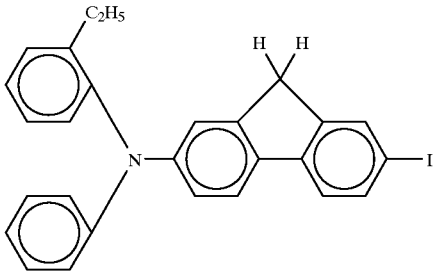
(3)-61
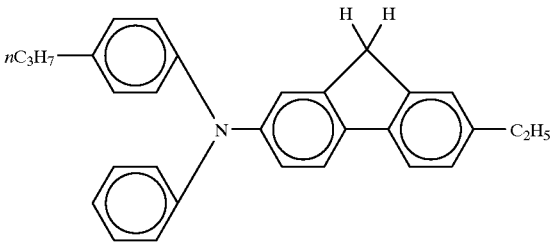
(3)-62
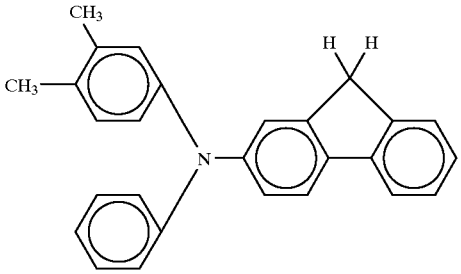

-continued
(3)-63
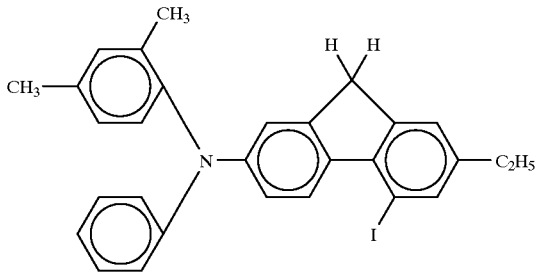
(3)-64
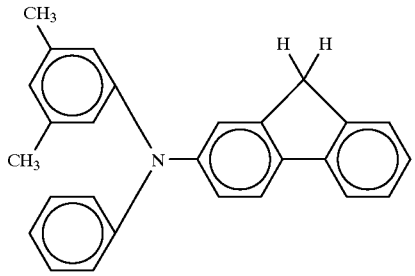
(3)-65
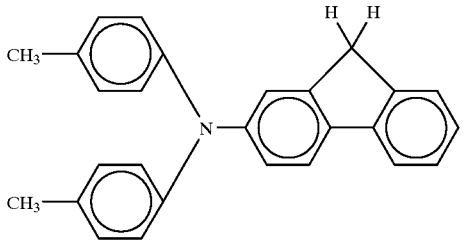
(3)-66
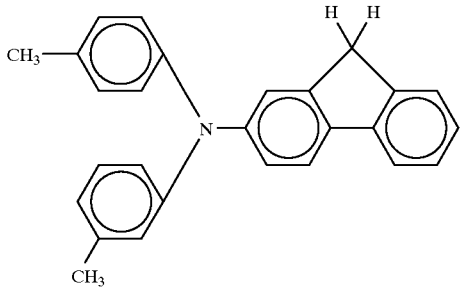
(3)-67
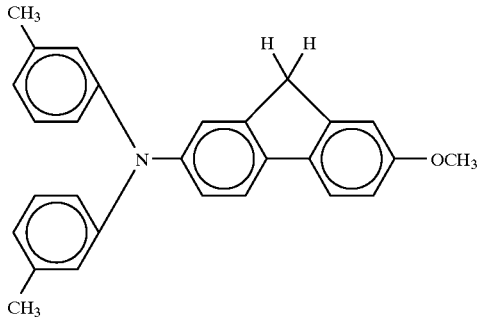

-continued
(3)-68
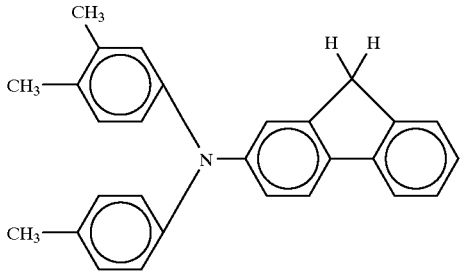
(3)-69
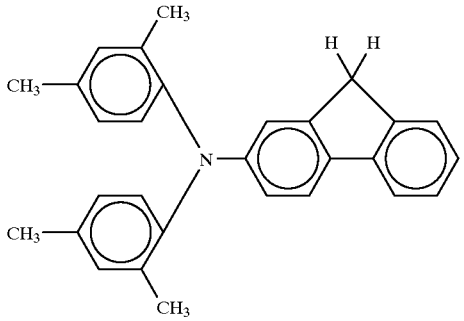
(3)-70
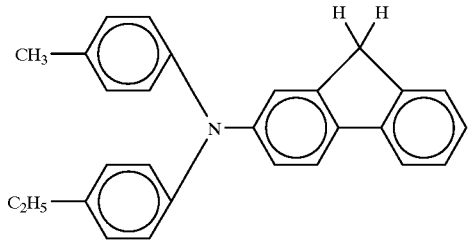
(3)-71
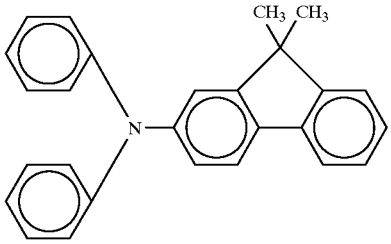
(3)-72
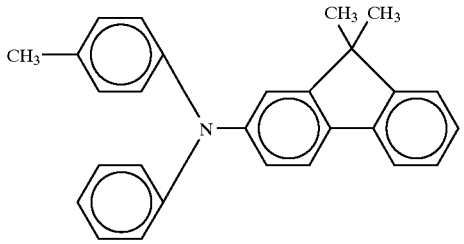

-continued
(3)-73
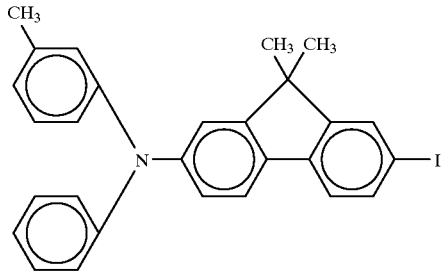
(3)-74
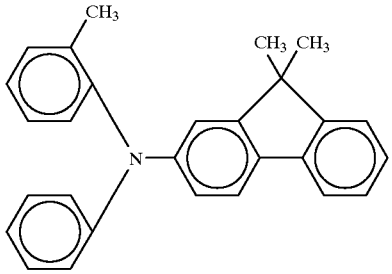
(3)-75
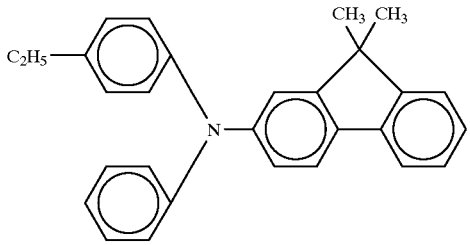
(3)-76
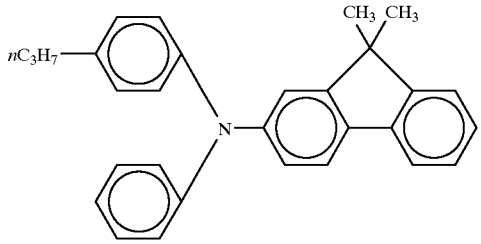
(3)-77
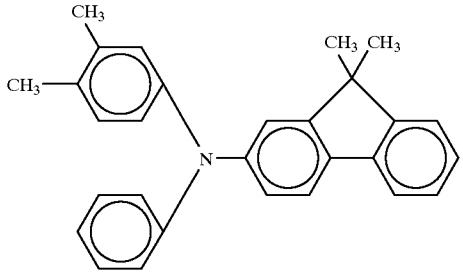

-continued
(3)-78
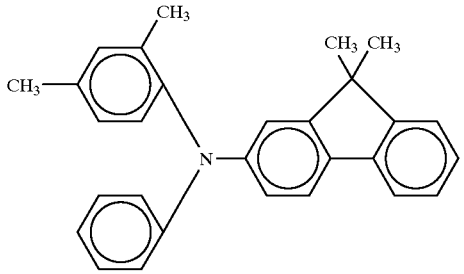
(3)-79
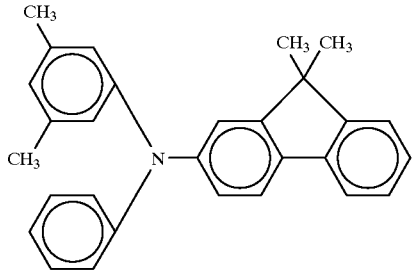
(3)-80
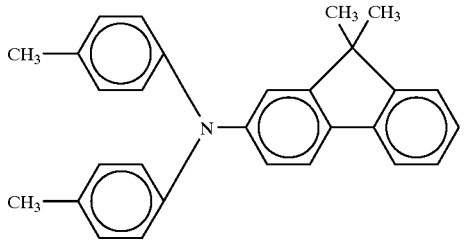
(3)-81
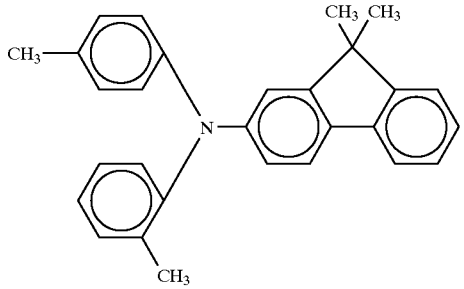
(3)-82
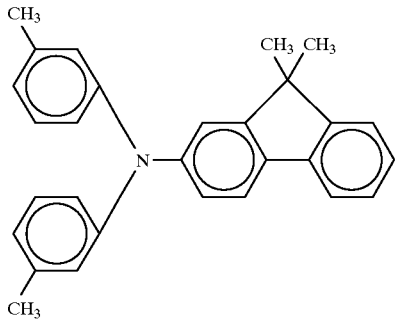

-continued
(3)-83
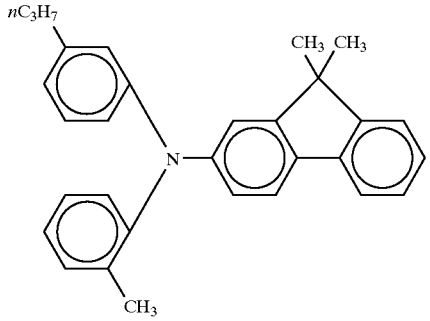
(3)-84
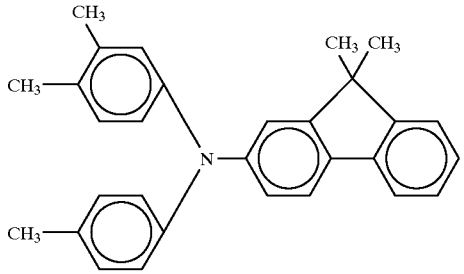
(3)-85
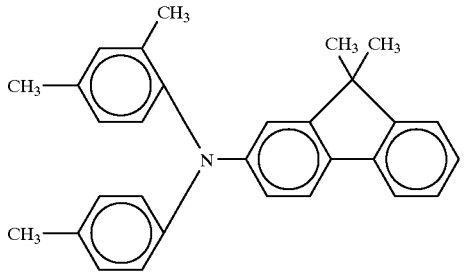
(3)-86
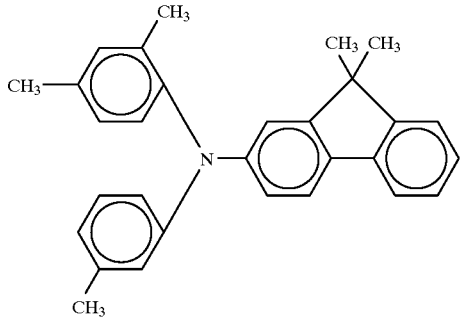
(3)-87
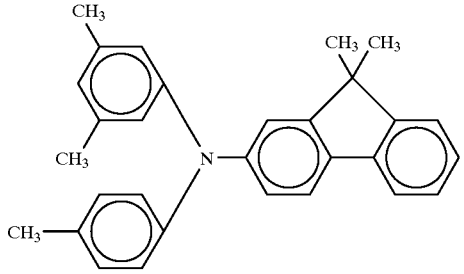

-continued
(3)-88
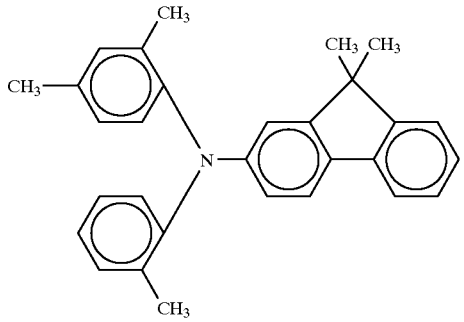
(3)-89
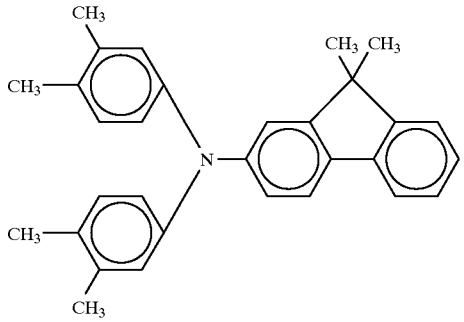
(3)-90
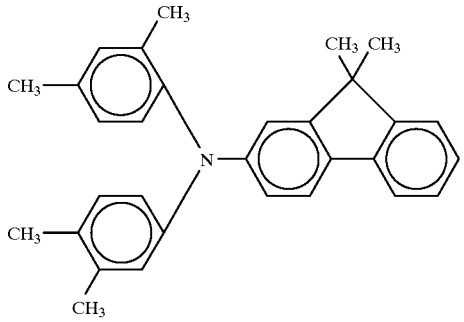
(3)-91
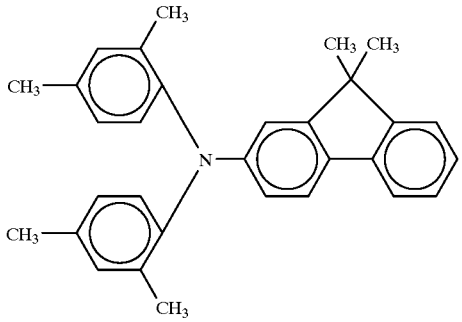

-continued
(3)-92
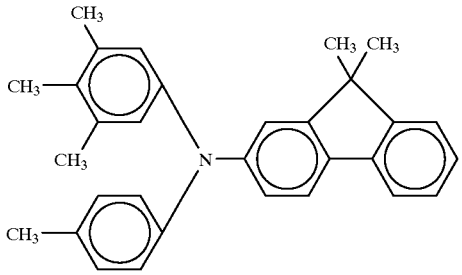
(3)-93
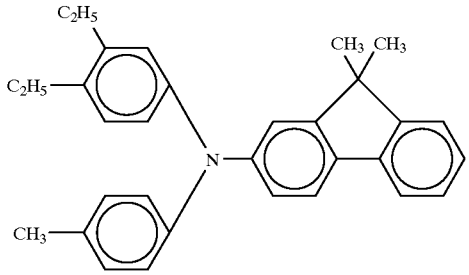
(3)-94
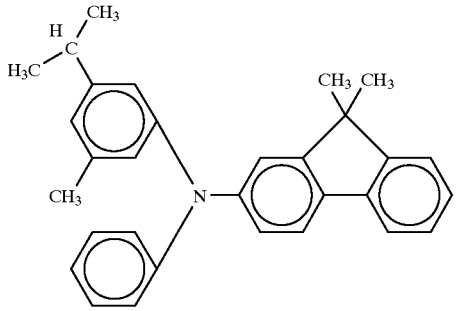
(3)-95
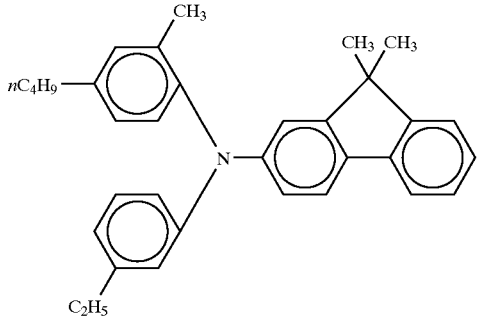
(3)-96
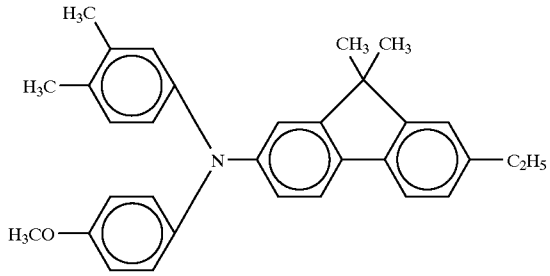

-continued
(3)-97
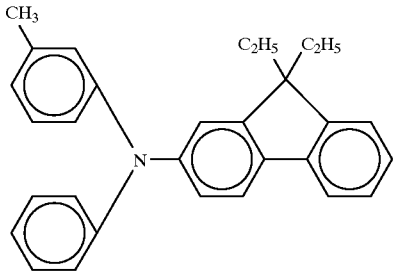
(3)-98
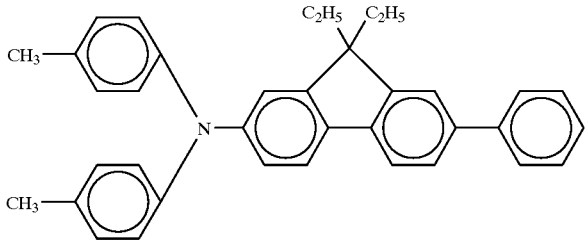
(3)-99
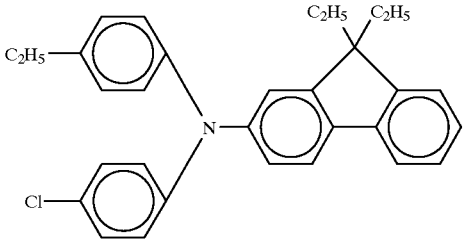
(3)-100
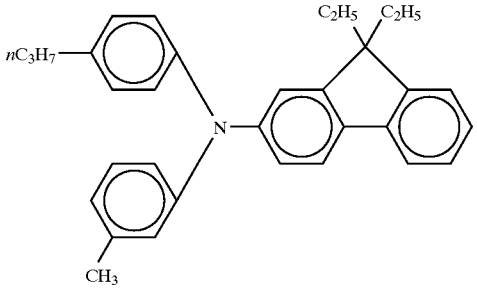
(3)-101
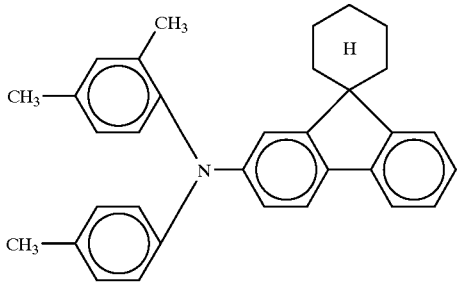

-continued
(3)-102
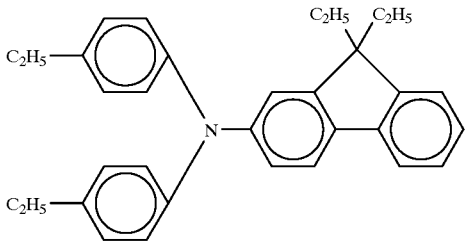
(3)-103
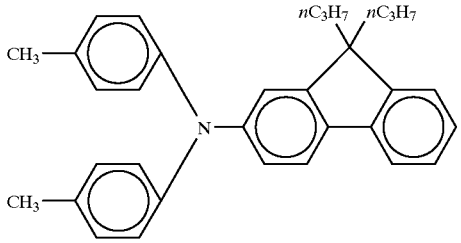
(3)-104
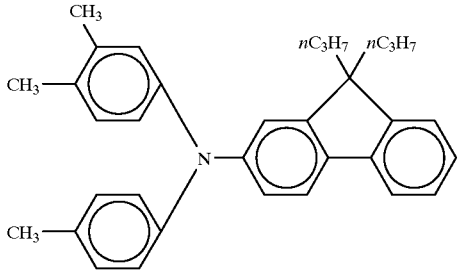
(3)-105
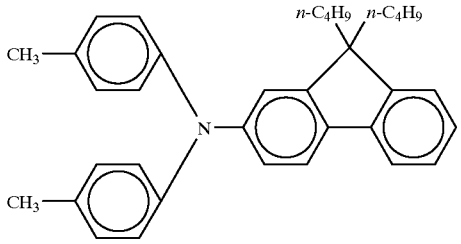
(3)-106
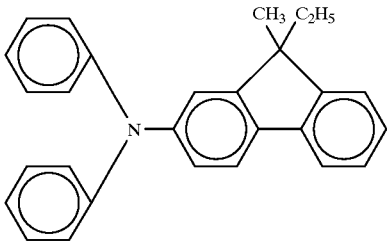
(3)-107
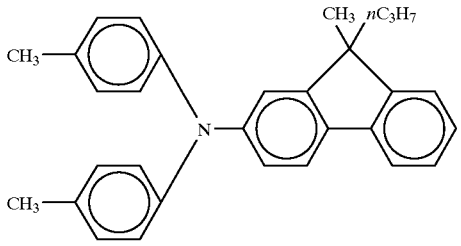

-continued
(3)-108
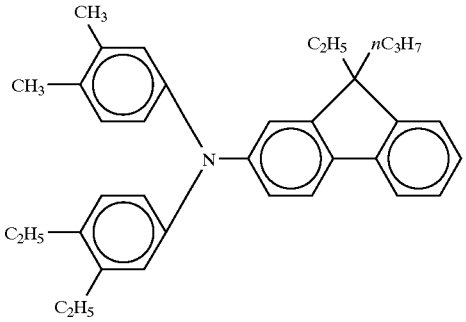
(3)-109
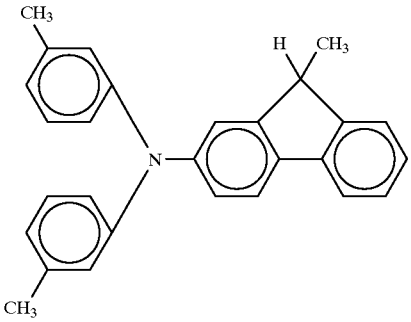
(3)-110
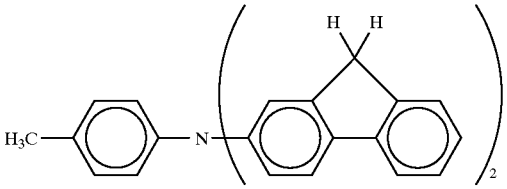
(3)-111
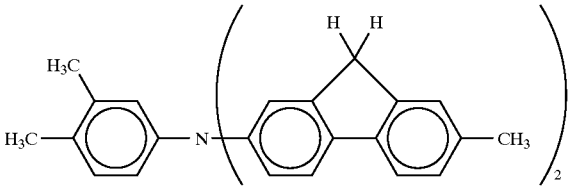
(3)-112
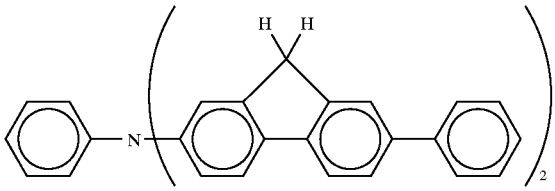
(3)-113
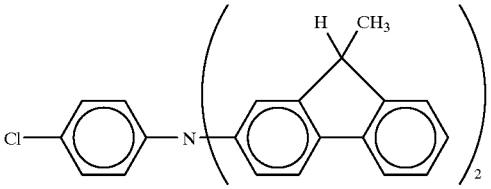

-continued
(3)-114
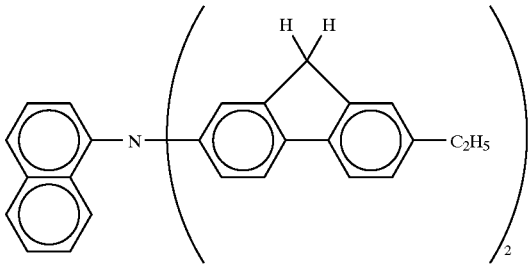
(3)-115
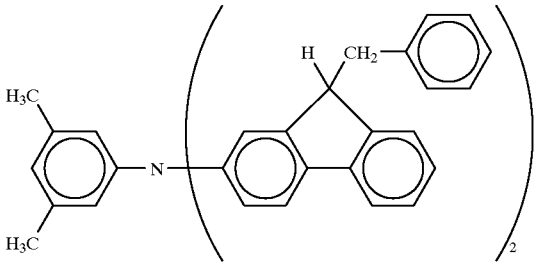
(3)-116
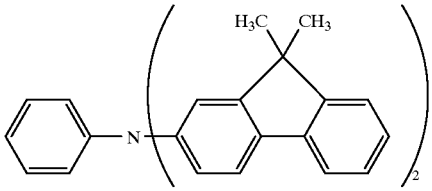
(3)-117
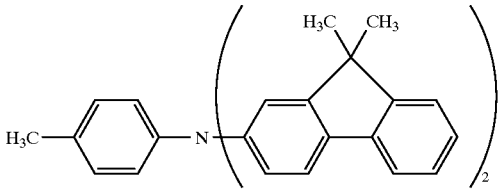
(3)-118
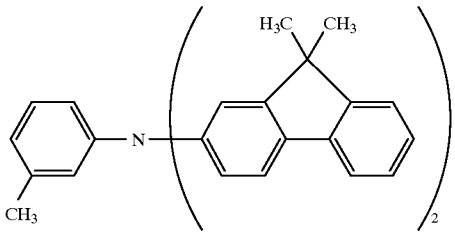
(3)-119
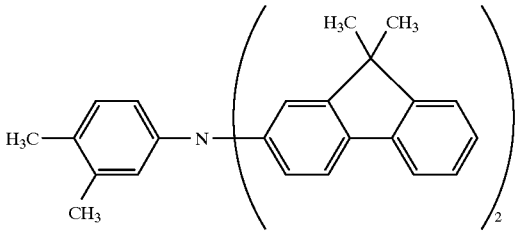

-continued
(3)-120
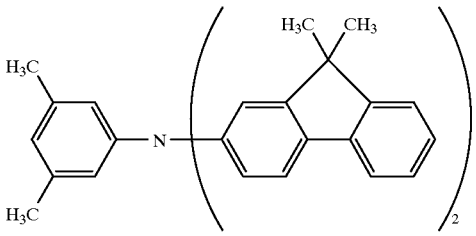
(3)-121
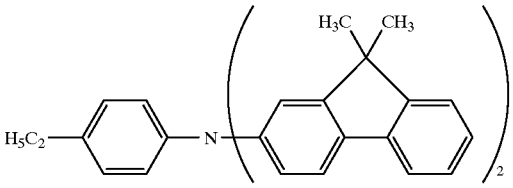
(3)-122
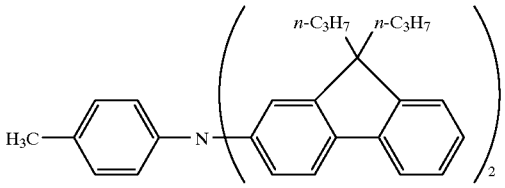
(3)-123
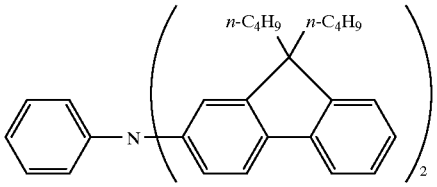
(3)-124
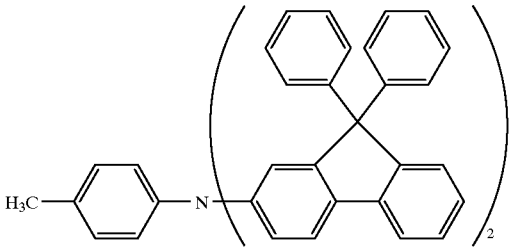
(3)-125
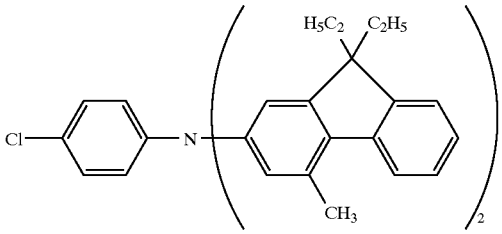
(3)-126
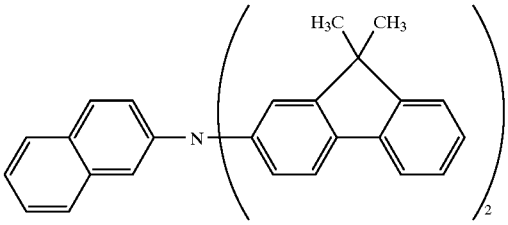

-continued
(3)-127
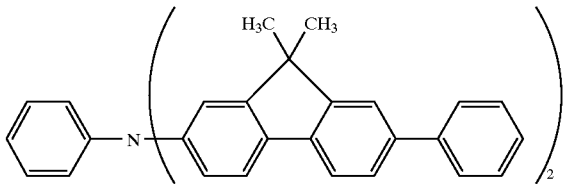
(3)-128
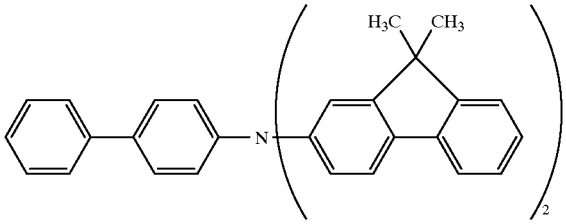
(3)-129
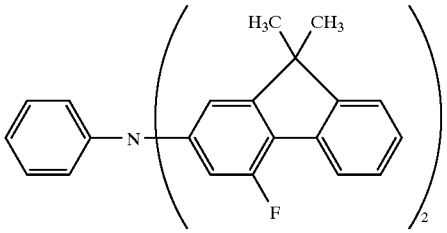
(3)-130
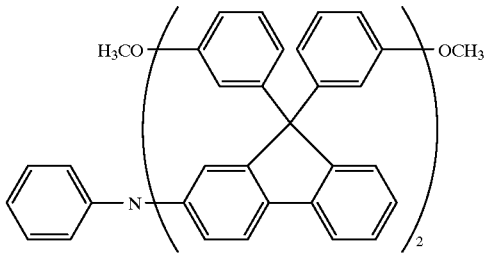
(3)-131
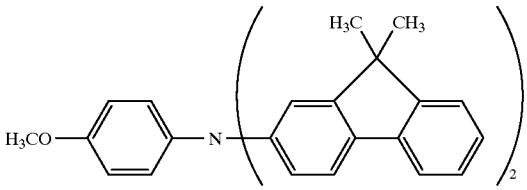
(3)-132
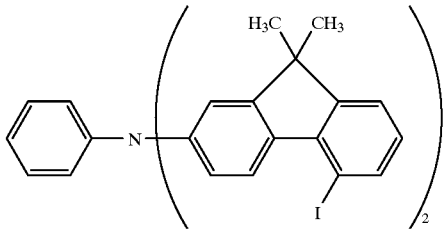
(3)-133
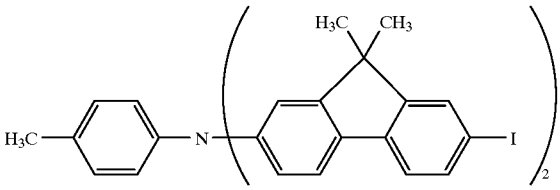

-continued
(3)-134
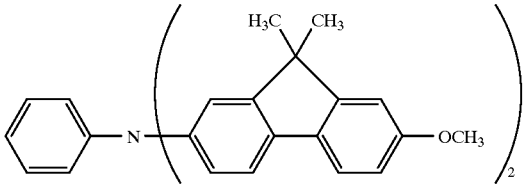
(3)-135
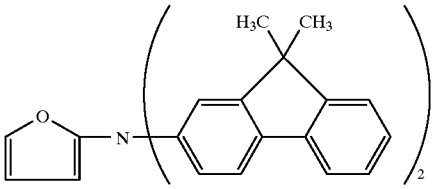
(3)-136
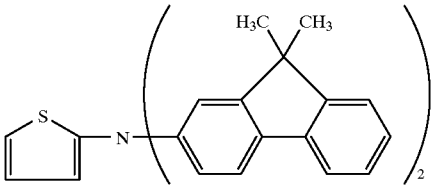
(3)-137
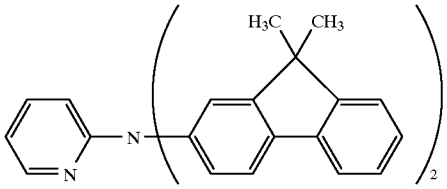
(3)-138
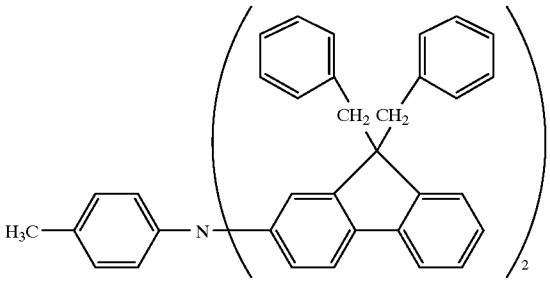
(3)-139
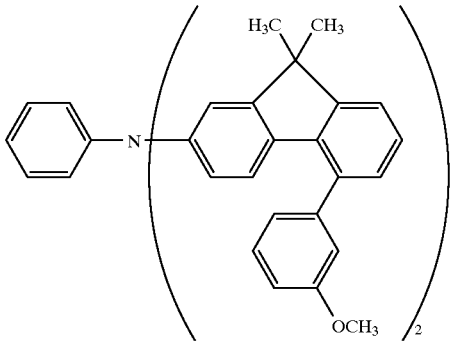

-continued
(3)-140
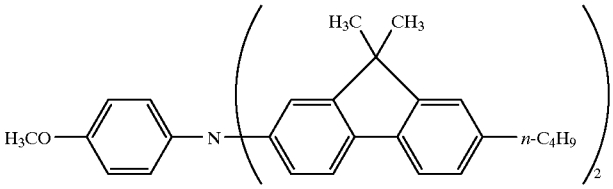
(3)-141
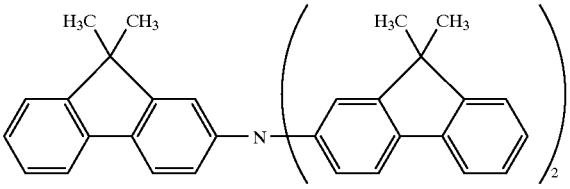
(3)-142
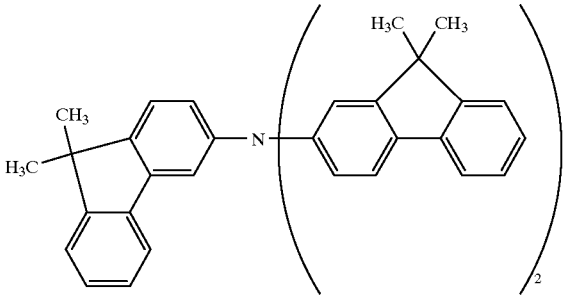
(3)-143
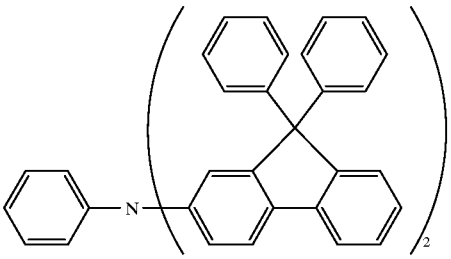
(3)-144
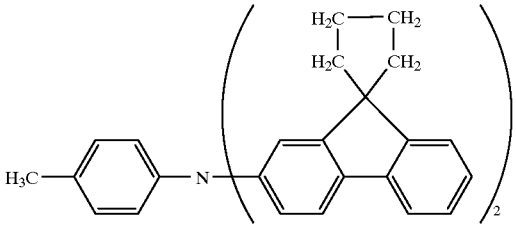
(3)-145
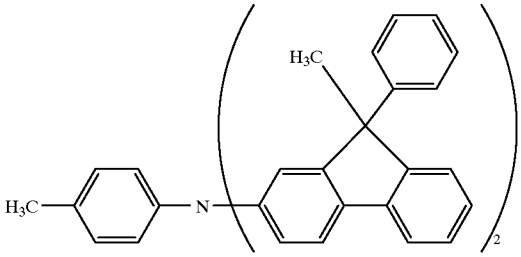

-continued
Stilbene compound (4)
(4)-1
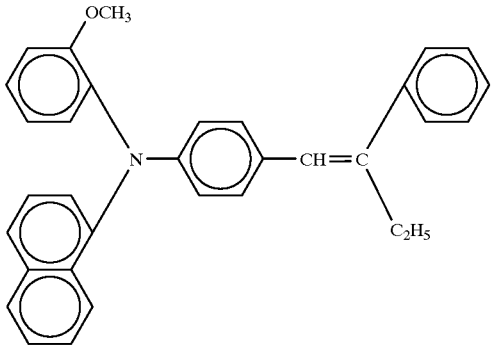
(4)-2
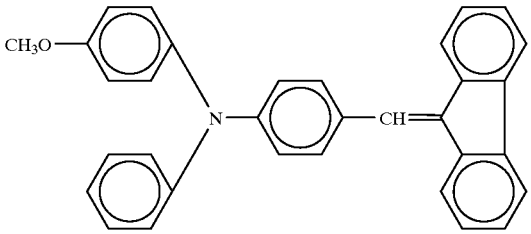
(4)-3
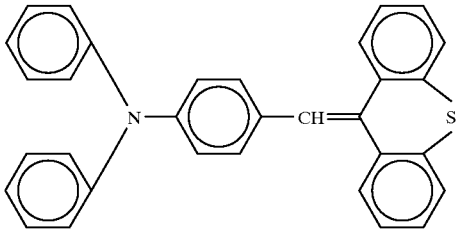
(4)-4
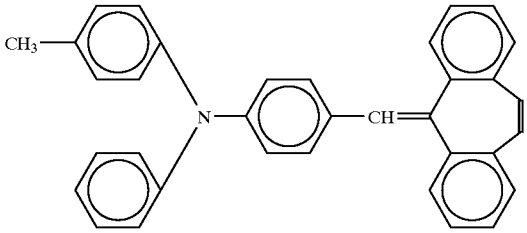
(4)-5
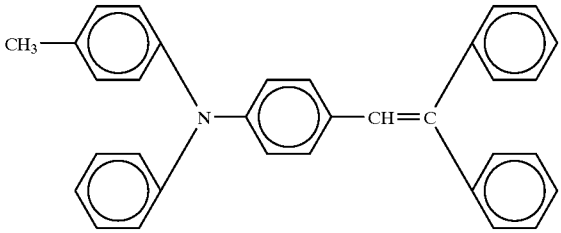

-continued
(4)-6
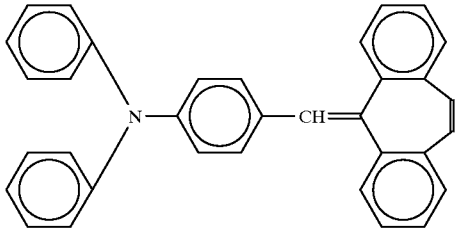
(4)-7
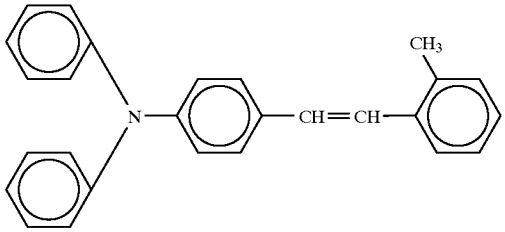
(4)-8
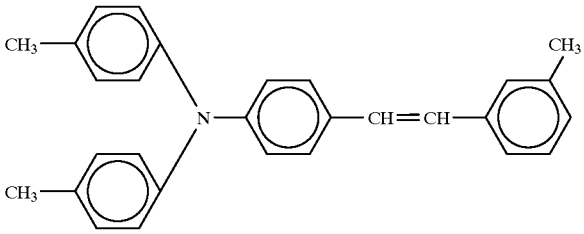
(4)-9
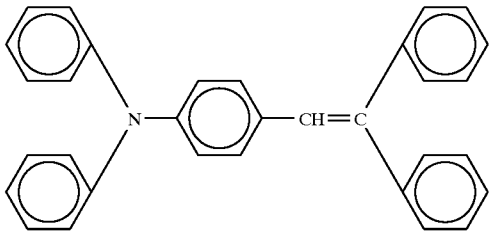
(4)-10
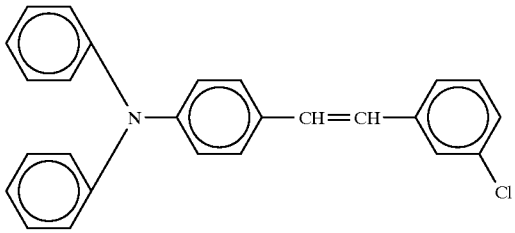
(4)-11
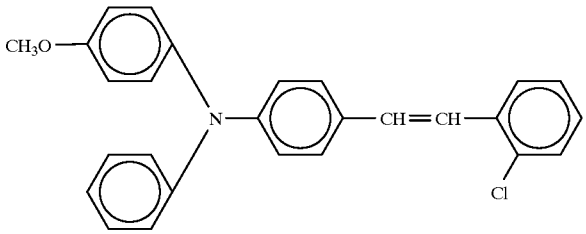

-continued
(4)-12
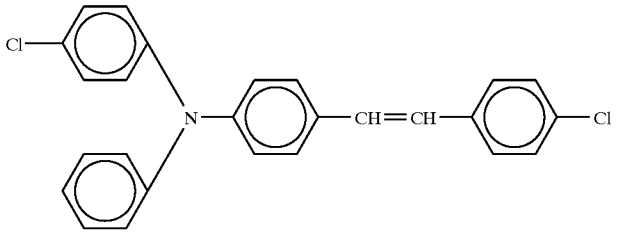
(4)-13
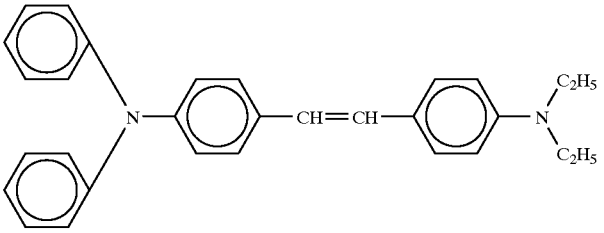
(4)-14
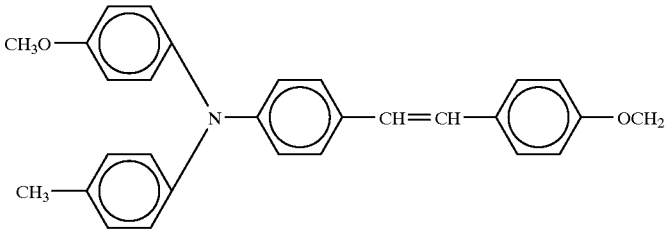
(4)-15
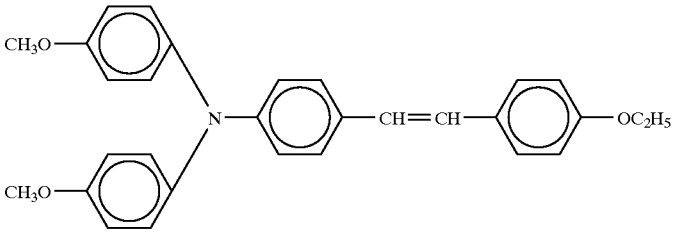
(4)-16
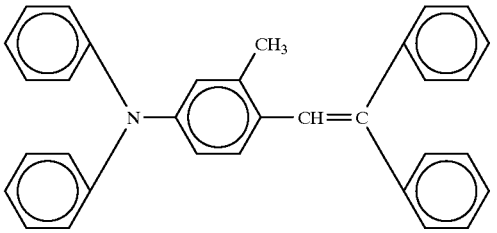
(4)-17
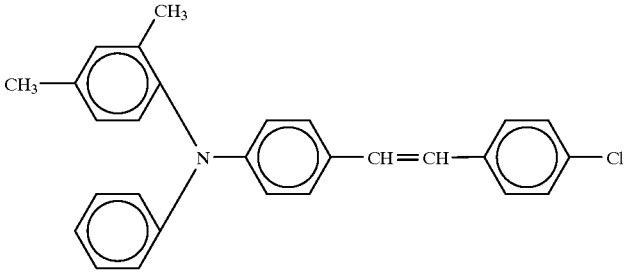

-continued
(4)-18
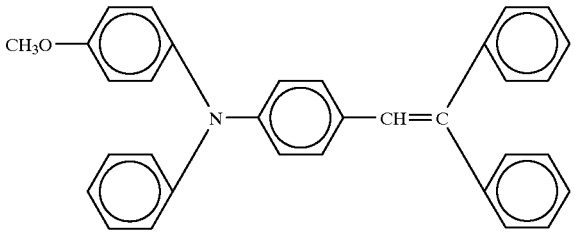
(4)-19
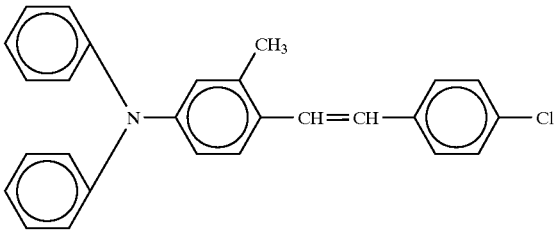
(4)-20
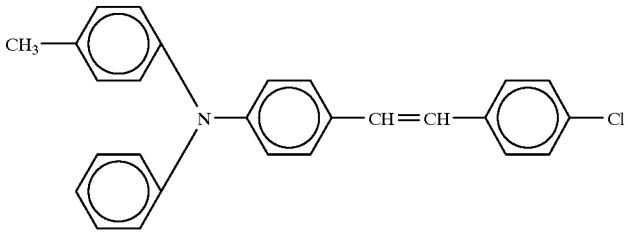
(4)-21
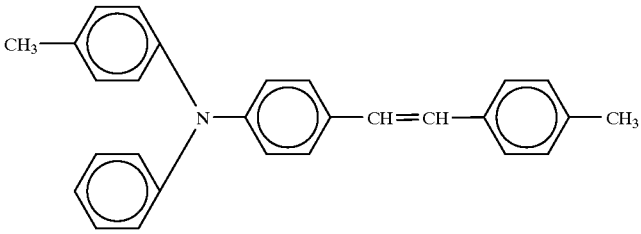
(4)-22
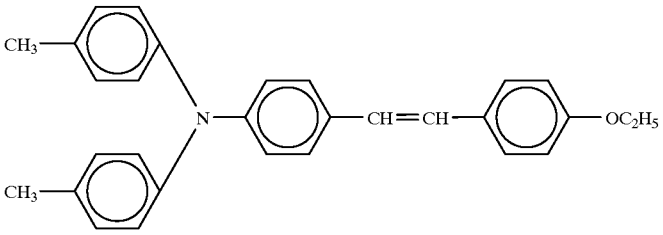
(4)-23
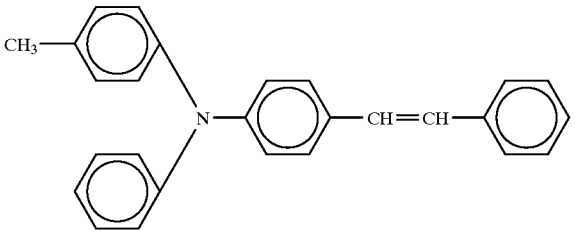

-continued
(4)-24
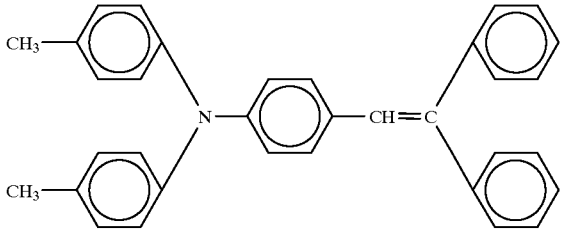
(4)-25
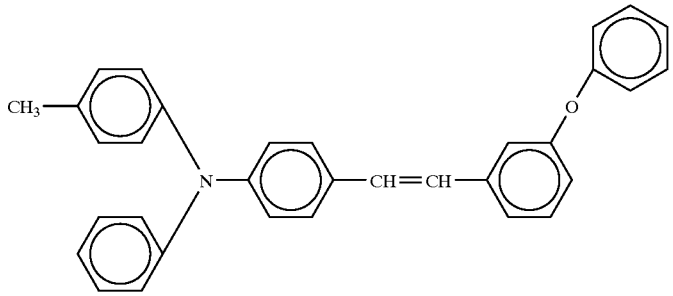
(4)-26
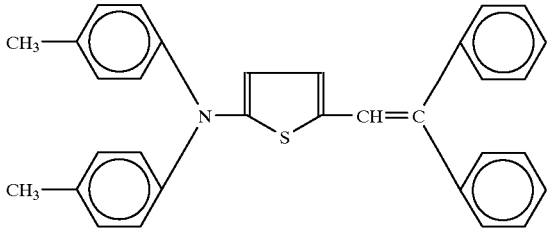
(4)-27
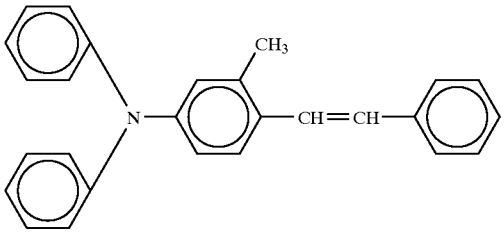
(4)-28
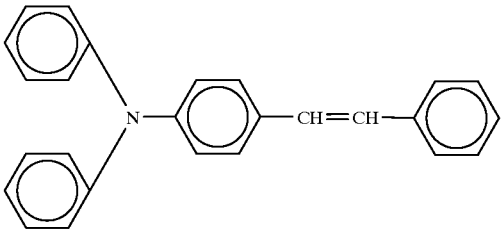
(4)-29
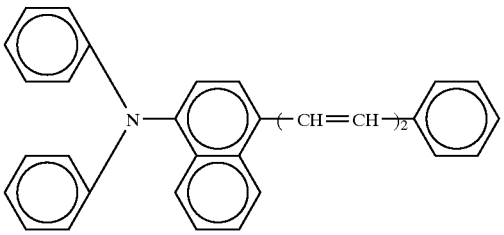

-continued
(4)-30
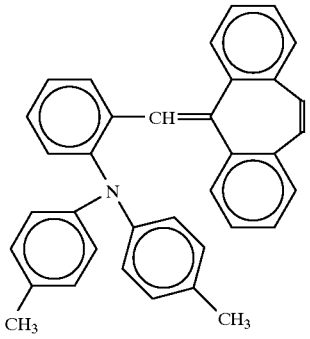
(4)-31
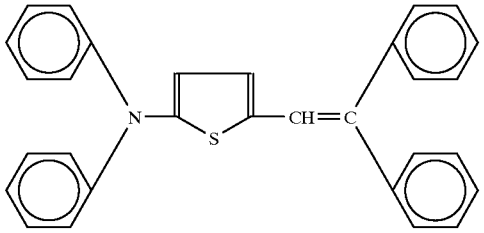
(4)-32
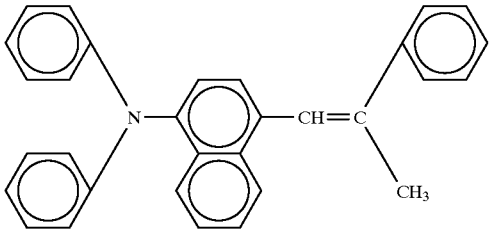
(4)-33
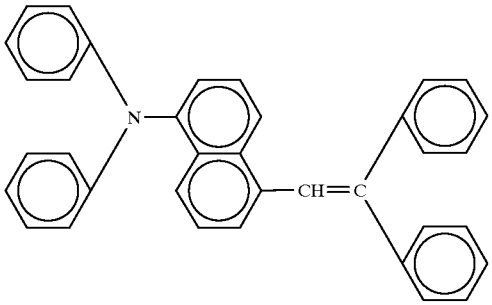
(4)-34
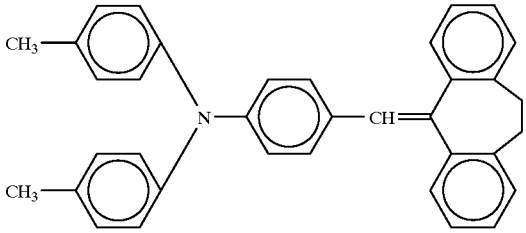

-continued
(4)-35
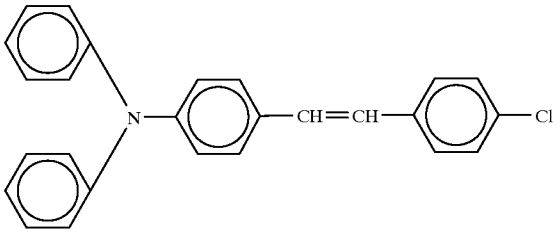
(4)-36
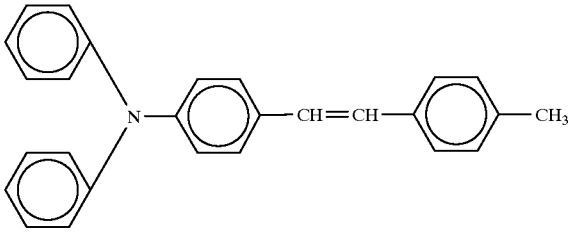
(4)-37
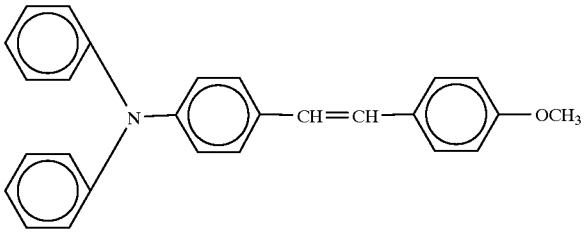
(4)-38
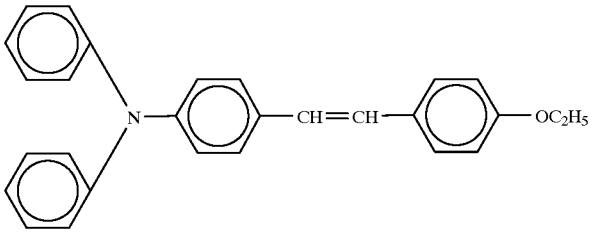
(4)-39
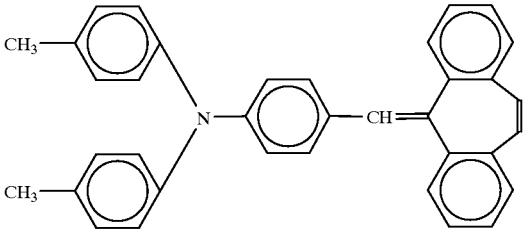
(4)-40
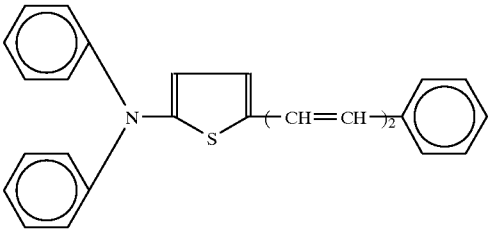

-continued
(4)-41
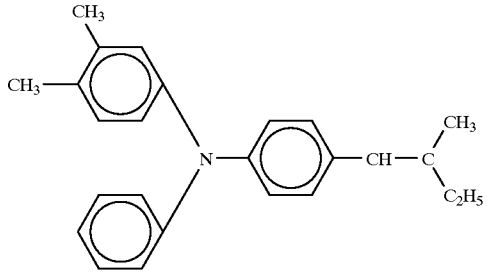
(4)-42
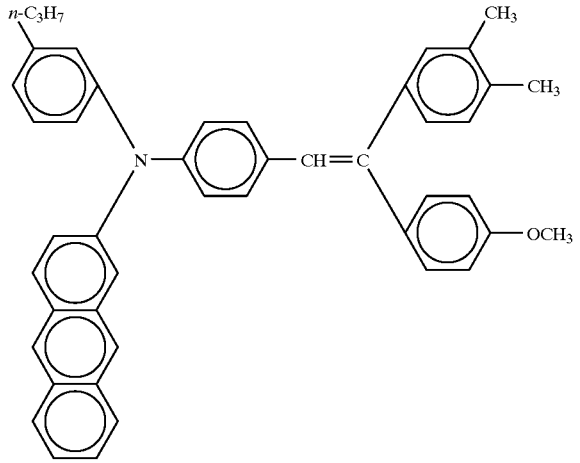
(4)-43
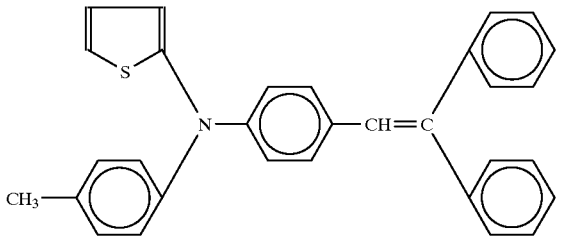
(4)-44
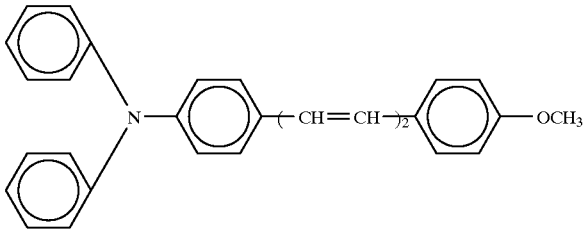
(4)-45
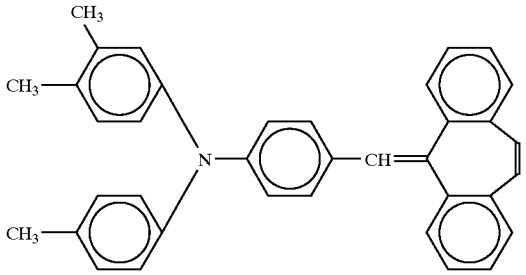

-continued
(4)-46
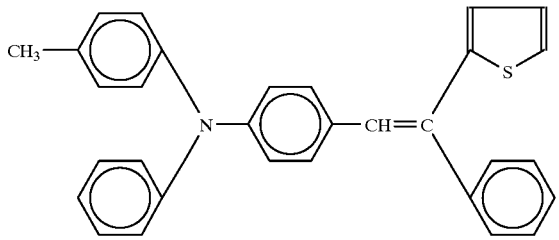
(4)-47
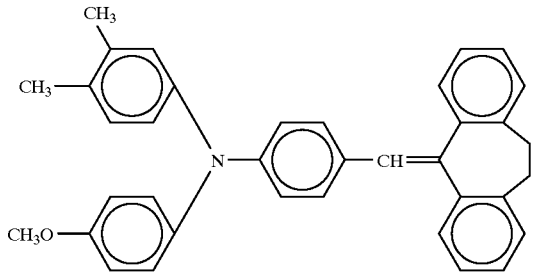
(4)-48
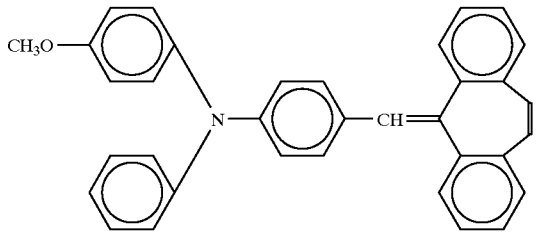
(4)-49
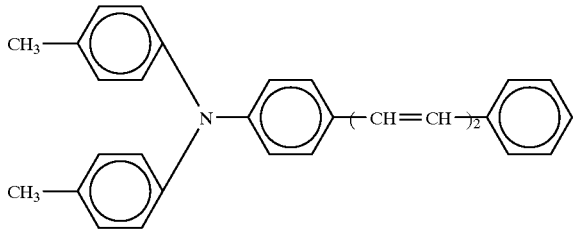
(4)-50
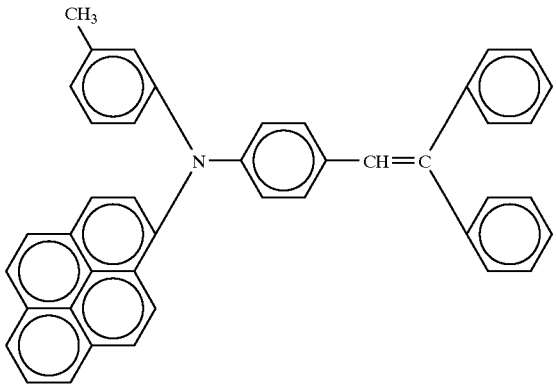
The above-mentioned fluorene compound of the formula (1) may be synthesized through a process as descried in JP-A 62-208054. The arylamine compound of the formula (3) may be synthesized through a process as described in JP-A 2-178666 and the stilbene compound of the formula (4) may be synthesized through a process as described in JP-A 63-225660.

The photosensitive layer of the electrophotographic photosensitive member of the present invention may, e.g., include the following layer structures:

(I) A lower layer containing a charge-generating material and an upper layer containing a charge-transporting material;

(II) A lower layer containing a charge-transporting material and a upper layer containing a charge-generating material; and (III) A single layer containing a charge-generating material and a charge-transporting material.

The fluorene compound of the formula (1), the arylamine compound of the formula (3) and the stilbene compound of the formula (4) each have a high hole-transporting ability accordingly may preferably be used as a charge-transporting material contained in the above-mentioned photosensitive layer having the structure of (I), (II) or (III). A polarity of a primary charge for use in charging step of the photosensitive member of the present invention may preferably be negative for the structure (I), positive for the structure (II) and negative or positive for the structure (III).

The photosensitive member of the present invention may preferably contain a photosensitive layer having the above-mentioned layer structure (I). Hereinbelow, the photosensitive member including such a photosensitive layer will be explained more specifically.

The photosensitive member comprises a support, a charge generation layer (CGL) containing a charge-generating material (CGM), a charge transport layer (CTL) containing a charge-transporting material (CTM) in this order and optionally comprises an undercoat layer. The CGL and CTL constitute a photosensitive layer as a whole.

The support may comprise any material being electroconductive including:

(i) A metal or an alloy such as aluminum, aluminum alloy, stainless steel or copper in the form of a plate or a drum (or a cylinder);

(ii) A laminated or vapor-deposited support comprising a non-electroconductive substance such as glass, a resin or pater, or the above support (i) each having thereon a layer of a metal or an alloy such as aluminum, palladium, rhodium, gold or platinum; and (iii) A coated or vapor-deposited support comprising a non-electroconductive substance such as glass, a resin or paper, or the above support (i) each having thereon a layer of an electroconductive substance such as an electroconductive polymer, tin oxide or indium oxide.

The CGM contained in the CGL may include:

(i) Azo pigments of monoazo-type, bisazo-type, trisazo-type, etc.;

(ii) Phthalocyanine pigments such as metallophthalocyanine and non-metallophthalocyanine;

(iii) Indigo pigments such as indigo and thioindigo;

(iv) Perylene pigments such as perylenic anhydride and perylenimide;

(v) Polycyclic quinones such as anthraquinone and pyrene-1,8-quinone;

(vi) Squalium colorants;

(vii) Pyrilium salts and thiopyrilium salts;

(viii) triphenylmethane-type colorants; and (ix) Inorganic substances such as selenium and amorphous silicon.

The above CGM may be used singly or in combination of two or more species.

In the present invention, the CGL may be formed on the support by vapor-deposition, sputtering or chemical vapor deposition (CVD), or by dispersing the CGM in an appropriate solution containing a binder resin and applying the resultant coating liquid onto the support by using a wet coating method such as dipping, spinner coating, roller coating, wire bar coating, spray coating or blade coating and then drying and coating. Examples of the binder resin used may be selected from various resins such as polycarbonate resin, polyester resin, polyarylate resin, polyvinyl butyral resin, polystyrene resin, polyvinyl acetal resin, diallylphthalate resin, acrylic resin, methacrylic resin, vinyl acetate resin, phenolic resin, silicone resin, polysulfone resin, styrene-butadiene copolymer, alkyd resin, epoxy resin, urea resin and vinyl chloride-vinyl acetate copolymer. These binder resins may be used singly or in combination of two or more species. The CGL may preferably contain the binder resin in an amount of at most 80 wt. %, particularly at most 40 wt. %, per the entire CGL. The CGL may preferably have a thickness of at most 5 $\mu$m, particularly 0.01 to 2 $\mu$m. The CGL may contain one or more know sensitizing agent, as desired.

The CTL according to the present invention may preferably be formed by dissolving a mixture of the above-mentioned fluorene compound or of the formula (1) and arylamine compound of the formula (3) or a mixture of the fluorene compound of the formula (1) and stilbene compound of the formula (4) in an appropriate solvent together with a binder resin, applying the resultant coating liquid such as solution onto a predetermined surface (e.g., the surface of a substrate, charge generation layer, etc.) by the above-mentioned coating method, and then drying the resultant coating.

Examples of the binder resin to be used for forming the CTRL may include: the resins used for the CGL described above; and photoconductive polymers such as poly-N-vinylcarbazole and polyvinylanthracene.

The CTM (i.e., the fluorene compound (1) and the arylamine compound (3) or the fluorene compound (1) and the stilbene compound (4)) may preferably be mixed with the binder resin in a total proportion of 10 to 500 wt. parts per 100 wt. parts of the binder resin.

The CTL and the CGL are electrically connected each other. Accordingly, the CTM contained in the CTL has functions of receiving charge carriers generated in the CGL and transporting the charge carries under electric field application.

The CTL may preferably have a thickness of 5 to 40 $\mu$m, particularly 10 to 30 $\mu$m, in view of a charge-transporting ability of the CTM since the CTM fails to transport the charge carries when a thickness of the CTL is too large. The CTL may contain further additives such as another charge transport material, an antioxidant, an ultraviolet absorbing agent, and a plasticizer, as desired.

In a case where a photosensitive layer has a single layer structure (i.e., the above-mentioned structure (III)), the photosensitive layer may preferably have a thickness of 5 to 40 $\mu$m, particularly 10 to 30 $\mu$m and may generally be formed in a similar manner as in the CGL and CTL.

In the present invention, the photosensitive member may further include an undercoat (primer) layer disposed between the substrate and the photosensitive layer in order to improve an adhesiveness therebetween and also to prevent charge (carrier) injection from the substrate.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, and other fields of applied electrophotography including, e.g., laser plate making.

The figure shows a schematic structural view of an electrophotographic apparatus including a process cartridge using an electrophotographic photosensitive member of the invention. Referring to the figure, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is imagewise exposed to light 4 (as by slit exposure or laser beam-scanning exposure) by using an image exposure means (not shown), whereby an electrostatic latent image is successively formed on the surface of the photosensitive member 1. The thus formed electrostatic latent image is developed (-receiving) by using a developing means 5 to form a toner image. The toner image is successively transferred to a transfer(-receiving) material 7 which is supplied from a supply part (not shown) to a position between the photosensitive member 1 and a transfer charger 5 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by means of a cleaning means 9 to provide a cleaned surface, and residual charge on the surface of the photosensitive member 1 is erased by a pre-exposure means issuing pre-exposure light 10 to prepare for the next cycle. As the primary charger 3 for charging the photosensitive member 1 uniformly, when a contact (or proximity) charging means is used, the pre-exposure means may be omitted, as desired.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, into a process cartridge detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail of the apparatus body.

In the case where the electrophotographic apparatus is used as a copying machine or a printer, image exposure may be effected by using reflection light or transmitted light from an original or by reading data on an original by a sensor, converting the data into a signal and then effecting a laser beam scanning, a drive of LED array or a drive of a liquid crystal shutter array in accordance with the signal.

Hereinbelow, the present invention will be explained based on Examples.

EXAMPLE 1

Onto an aluminum sheet, a solution of 4 g of N-methoxymethylated 6-nylon (weight-average molecular weight (Mw)=32,000) and 10 g of alcohol-soluble nylon copolymer (Mw=29,000) in 100 g of methanol was applied by wire bar coating, followed by drying to form a 1 $\mu$m-thick undercoat layer.

A coating liquid for a change generation layer was prepared by adding 14 g of a bisazo pigment shown below to a solution of 7 g of a butyral resin (butyral degree=63 mol. %) in 290 ml of cyclohexanone and dispersing the mixture for 20 hours in a sand mill.

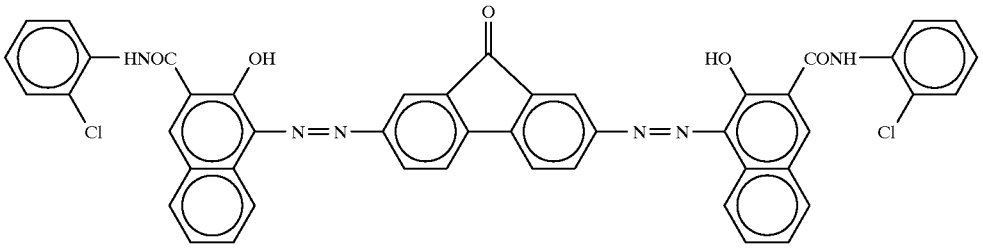

The thus prepared coating was applied onto the undercoat layer by using a wire bar to form a 0.1 $\mu$m-thick charge generation layer.

Then, 7 g of a fluorene compound (Ex. Comp. No. (1)-84), 3 g of an arylamine compound (Ex. Comp. No. (3)-80) and 10 g of a bisphenol Z-type polycarbonate resin (Mw=20,000) were dissolved in 77 g of a monochlorobenzene to prepare a coating liquid for a charge transport layer.

The coating liquid was applied onto the charge generation layer by means of a wire bar, followed by drying to form a 20 $\mu$m-thick charge transport layer, thus preparing an electrophotographic photosensitive member.

The thus prepared photosensitive member was negatively charged by using corona (−5 KV) according to a static scheme by using of an electrostatic copying paper tester (Model: SP-428, mfd. by Kawaguchi Denki K.K.) and retained in a dark place for 1 sec. Thereafter, the photosensitive member was exposed to halogen light at an illuminance of 20 lux to evaluate charging characteristics. More specifically, the charging characteristics were evaluated by measuring a surface potential ($V_0$) at an initial stage (immediately after the charging), a surface potential ($V_1$) after a dark decay for 1 sec, and the exposure quantity ($E_{1/5}$: lux.sec) (i.e., sensitivity) required for decreasing the potential $V_1$ to ⅕ thereof.

In order to evaluate a resistance to abrasion, a photosensitive member was prepared in the same manner as above except that the aluminum sheet was charged to an aluminum cylinder (diameter=80 mm, length=360 mm) and that the coating method was changed to dipping and was incorporated in a plane paper copying machine "NP-3825", manufactured by Canon K.K.) and subjected to 5000-sheets of successive image formation to measure the thickness of the photosensitive layer.

The degree of abrasion was evaluated as a difference in thickness based on values measured before and after the successive image formation by using an eddy current-type thickness measurement apparatus ("PERMASCOPE TYPE E111, mfd. by Fischer Co.)

The results are shown in Table 1 appearing hereinafter.

EXAMPLES 2–13 AND COMPARATIVE EXAMPLES 1–13

Photosensitive members were prepared and evaluated in the same manner as in Example 1 except for using the charge transport material(s) shown in Tables 1 and 2 including the following comparative compounds (A), (B) and (C).

Comparative compound (A)

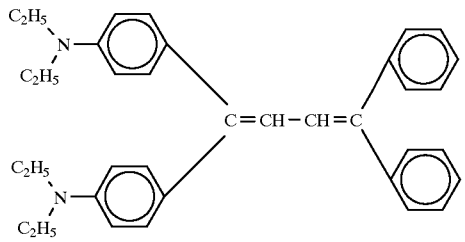

Comparative compound (B)

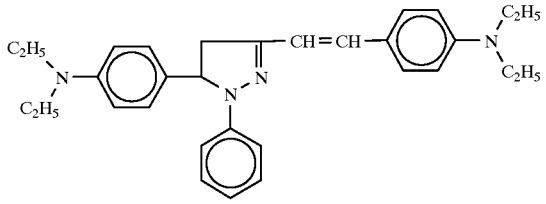

Comparative compound (C)

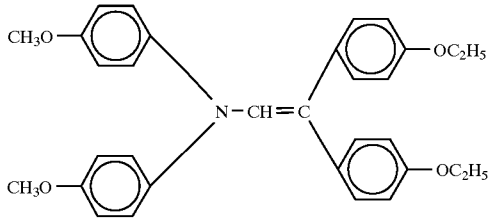

The results are shown in Table 1 (Examples 1–13) and Table 2 (Comparative Examples 1–13), respectively.

TABLE 1

| Ex. No. | Ex.Comp.No./ amount | | Initial $V_0(-V)$ | Initial $V_1(-V)$ | $E_{1/5}$ (lux.sec.) | Abration after 5000 sheets (μm) |
|---|---|---|---|---|---|---|
| 1 | (1)-84 | 7 g | 702 | 700 | 1.2 | 0.8 |
| | (3)-80 | 3 g | | | | |
| 2 | (1)-20 | 7 g | 699 | 695 | 1.3 | 0.9 |
| | (3)-84 | 3 g | | | | |
| 3 | (1)-65 | 2 g | 700 | 698 | 1.3 | 0.8 |
| | (3)-107 | 8 g | | | | |
| 4 | (1)-86 | 5 g | 699 | 694 | 1.1 | 1.1 |
| | (3)-97 | 5 g | | | | |
| 5 | (1)-28 | 9 g | 699 | 695 | 1.0 | 0.7 |
| | (3)-71 | 1 g | | | | |
| 6 | (1)-22 | 4 g | 700 | 699 | 1.5 | 1.0 |
| | (3)-111 | 6 g | | | | |
| 7 | (1)-33 | 5 g | 697 | 691 | 1.4 | 1.1 |
| | (3)-116 | 5 g | | | | |
| 8 | (1)-60 | 7 g | 698 | 693 | 1.2 | 0.9 |
| | (3)-117 | 3 g | | | | |
| 9 | (1)-7 | 2 g | 703 | 700 | 1.3 | 1.0 |
| | (3)-144 | 8 g | | | | |
| 10 | (1)-19 | 1 g | 702 | 698 | 1.3 | 1.2 |
| | (3)-4 | 9 g | | | | |
| 11 | (1)-29 | 8 g | 701 | 696 | 1.6 | 1.2 |
| | (3)-6 | 2 g | | | | |
| 12 | (1)-83 | 6 g | 700 | 695 | 1.7 | 1.1 |
| | (3)-41 | 4 g | | | | |
| 13 | (1)-51 | 6 g | 698 | 694 | 1.5 | 1.0 |
| | (3)-15 | 4 g | | | | |

TABLE 2

| Comp. Ex. No. | Ex.Comp.No./ amount | | Initial $V_0(-V)$ | Initial $V_1(-V)$ | $E_{1/5}$ (lux.sec) | Abration after 5000 sheets (μm) |
|---|---|---|---|---|---|---|
| 1 | (1)-84 | 10 g | 700 | 697 | 2.1 | 1.9 |
| 2 | (1)-65 | 10 g | 701 | 696 | 1.8 | 1.8 |
| 3 | (1)-28 | 10 g | 695 | 690 | 1.9 | 2.2 |
| 4 | (3)-84 | 10 g | 702 | 697 | 1.5 | 1.8 |
| 5 | (3)-107 | 10 g | 697 | 694 | 1.6 | 1.7 |
| 6 | (3)-116 | 10 g | 698 | 694 | 1.9 | 2.0 |
| 7 | (3)-117 | 10 g | 699 | 696 | 1.8 | 1.5 |
| 8 | (3)-144 | 10 g | 698 | 693 | 2.0 | 2.1 |
| 9 | (3)-6 | 10 g | 702 | 695 | 2.4 | 1.9 |
| 10 | (3)-41 | 10 g | 701 | 696 | 1.8 | 2.2 |
| 11 | (1)-84 | 7 g | 695 | 680 | 1.9 | 2.6 |
| | (A) | 3 g | | | | |
| 12 | (1)-84 | 7 g | 691 | 681 | 2.1 | 2.1 |
| | (B) | 3 g | | | | |
| 13 | (1)-84 | 7 g | 700 | 689 | 1.5 | 2.2 |
| | (C) | | | | | |

As apparent from the results shown in Tables 1 and 2, the photosensitive members according to the present invention showed a high sensitivity and an excellent abrasion resistance.

EXAMPLE 14

Onto an aluminum sheet, a solution of 5 g N-methoxymethylated 6-nylon (Mw=32,000) and 10 g of alcohol-soluble nylon copolymer (Mw=29,000) in 95 g of methanol was applied by wire bar coating, followed by drying to form a 1.2 μm-thick undercoat layer.

A coating liquid for a charge generation layer was prepared by mixing 10 g of oxytitaniumphthalocyanine, 7 g of a butyral resin (butyral degree=68 mol. %; Mw=35000) and 90 ml of dioxane and dispersing the mixture for 24 hours in a ball mill.

The thus prepared coating liquid was applied onto the undercoat layer by blade coating to form a 0.2 μm-thick charge generation layer.

Then, 7 g of fluorene compound. (Ex. Comp. No. (1)-85), 3 g of an arylamine compound. (Ex. Comp. No. (3)-96) and 10 g of a polymethylmethacrylate resin (Mw=25,000) were dissolved in 70 g of a monochlorobenzene to prepare a coating liquid for a charge transport layer.

The coating liquid was applied onto the charge generation layer by means of a wire bar, followed by drying to form a 23 μm-thick charge transport layer, thus preparing an electrophotographic photosensitive member.

The thus prepared photosensitive member was subjected to measurement of potentials $V_0$ and $V_1$ and the exposure quantity (energy) ($E_{1/5}$, μJ/cm$^2$) in the same manner as in Example 1 except that the light source used in this example was laser light (output: 5 mW, emission wavelength: 780 nm) emitted from a semiconductor comprising gallium/aluminum/arsenic.

Another photosensitive member for evaluating the abrasion resistance was prepared in the same manner as in Example 1 except for using an aluminum cylinder (diameter=30 mm, length=260.5 mm) and was incorporated in a laser beam printer (trade name: LBP-SX mfd. by Canon K.K.) as an electrophotographic printer equipped with the above-mentioned semiconductor laser and using a reversal development system, and subjected to 5000 sheets of successive image formation to evaluate the abrasion resistance in the same manner as in Example 1.

The image formation conditions were as follows:

dark-part potential $V_D$: −700 V light-part potential $V_L$: −150 V (exposure quantity: 0.7 μJ/cm$^2$)

transfer potential: +700 V polarity of developing: negative process speed: 50 mm/sec developing bias: −450 V image exposure scanning system: image scan scheme pre-exposure (prior to the primary charging): 4.0 lux.sec (whole surface exposure using red light)

The results are shown in Table 3 appearing hereinafter.

EXAMPLE 15

Onto an aluminum sheet, a 7.2 wt. %-solution of alcohol-soluble nylon copolymer (nylon 6-66-610-12 copolymer; Mw=30,000) in methanol was applied and dried to form a 0.65 μm-thick undercoat layer.

A dispersion of a charge generation material was prepared by adding 5.8 g of a bisazo pigment shown below to 100 ml of tetrahydrofuran and dispersing the mixture for 48 hours in a sand mill.

Then, 3 g of a fluorene compound (Ex. Comp. No. (1)-82), 3 g of an arylamine compound (Ex. Comp. No. (3)-121) and 10 g of a bisphenol A-type polycarbonate resin (Mw=20,000) were dissolved in 42 g of a monochlorobenzene/dichloromethane (=3/1 by weight) to prepare a solution of charge transport materials, which was added to the above-prepared dispersion, followed by dispersion for 6 hours in a sand mill to obtain a coating liquid.

The coating liquid was applied onto the undercoat layer by means of a wire bar, followed by drying to form a 22 μm-thick photosensitive layer, thus preparing an electrophotographic photosensitive member.

The thus prepared photosensitive member was evaluated in the same manner as in Example 1.

The results are shown in Table 3 below.

TABLE 3

| Ex. No. | Ex.Comp.No./ amount | | Initial $V_0$(−V) | Initial $V_1$(−V) | $E_{1/5}$ | Abration after 5000 sheets (μm) |
|---|---|---|---|---|---|---|
| 14 | (1)-85 | 7 g | 705 | 699 | 1.2 | 1.3 |
| | (3)-96 | 3 g | | | (μJ/cm$^2$) | |
| 15 | (1)-82 | 3 g | 688 | 682 | 3.1 | 1.2 |
| | (3)-121 | 3 g | | | (lux.sec) | |

EXAMPLE 16

A coating liquid for a charge generation layer was prepared by adding 4 g of a bisazo pigment of the formula:

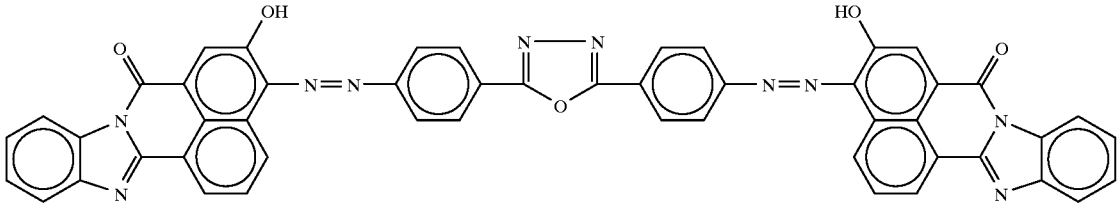

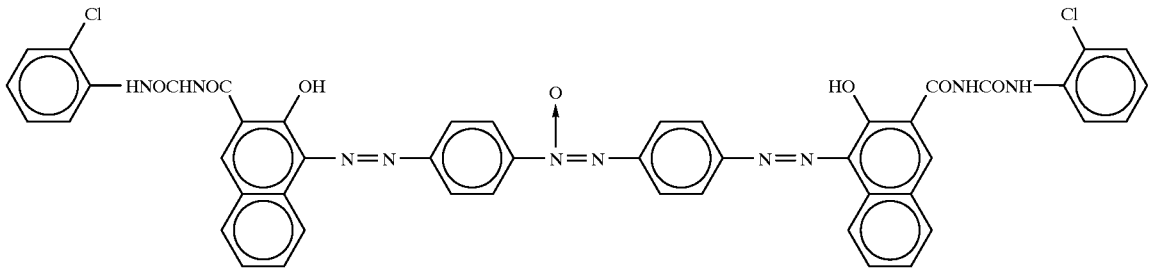

to a solution of 2 g of a butyral resin (butyral degree of 68 mol. %) in 100 ml of cyclohexanone and dispersing the mixture for 24 hours in a sand mill.

The coating liquid was applied onto an aluminum sheet by a wire bar and dried to obtain a 0.22 $\mu$m-thick charge generation layer.

Then, 7 g of a fluorene compound (Ex. Comp. No. (1)-12), 3 g of a stilbene compound (Ex. Comp. No. (4)-5) and 10 g of polycarbonate resin (Mw=25,000) were dissolved in 70 g of monochlorobenzene to prepare a coating liquid.

The coating liquid was applied onto the above-prepared charge generation layer by means of a wire bar, followed by drying to form a charge transport layer having a thickness of 22 $\mu$m, whereby an electrophotographic photosensitive member was prepared.

The thus prepared photosensitive member was negatively charged by using corona (−5 KV) according to a static scheme by using an electrostatic copying paper tester (Model SP-428, mfd. by Kawaguchi Denki K.K.) and retained in a dark place for 1 sec. Thereafter, the photosensitive member was exposed to halogen light at an illuminance of 20 lux to evaluate charging characteristics. More specifically, the charging characteristics were evaluated by measuring a surface potential ($V_0$) at an initial stage (immediately after the charging), a surface potential ($V_1$) after a dark decay for 1 sec, and the exposure quantity ($E_{1/5}$: lux.sec) (i.e., sensitivity) required for decreasing the potential $V_1$ to ⅕ thereof.

In order to evaluate fluctuations of a light part potential ($V_L$) and a dark part potential ($V_D$), the above photosensitive member was attached to a cylinder for a photosensitive drum of a plane paper copying machine ("NP-3825", manufactured by Canon K.K.) and subjected to 2,000 sheets of successive image formation at 23° C. and 50% RH on condition that $V_D$ and $V_L$ at an initial stage were set to −700 V and −200 V, respectively. After 2,000 sheets of successive image formation $V_D$ and $V_L$ were measured to obtain the fluctuations $\Delta V_D$ and $\Delta V_L$ (differences in $V_D$ and $V_L$ between those before and after the image formation (2000 sheets)), respectively.

The results are shown in Table 4 appearing hereinafter.

In table 4, positive values of $\Delta V_D$ and $\Delta V_L$ represented an increase in absolute values of $V_D$ and $V_L$ and negative values represented a decrease in absolute values of $V_D$ and $V_L$, after the image formation.

In a similar manner, fluctuations (differences in potentials) $\Delta V_D'$ and $\Delta V_L'$ with respect to 1000 sheets of successive image formation at 30° C. and 80% RH were evaluated after the above photosensitive member was left standing overnight at 30° C. and 80% RH.

The photosensitive member was also subjected to an accelerated test of a crack in a photosensitive layer and an accelerated test of crystallization of a charge-transporting material as follows.

Crack

The surface of the photosensitive member was touched or pressed by a finger to attach a fatty component of the finger to the surface of the photosensitive member, followed by standing for 8 hours under normal temperature and normal pressure. After a lapse of a prescribed hour, the touched part of the photosensitive member was subjected to observation with a microscope (VERSAMET 6390, manufactured by Union Co.; magnification=50) whether crack was generated or not.

Crystallization

The above photosensitive member treated with a finger was left standing for 1 week at 80° C. After a lapse of a prescribed day, the touched part of the photosensitive member is subjected to observation with the above-mentioned microscope (magnification=50) whether an crystallization is generated or not.

The results are shown in Table 5 appearing hereinafter.

EXAMPLES 17–28 AND COMPARATIVE EXAMPLES 14–23

Photosensitive members were prepared and evaluated in the same manner as in Example 16 except for using the charge transport material(s) shown in Tables 4–7 (appearing hereinafter) including the following comparative compounds (D), (E), (F) and (G).

Comparative Compound (D)
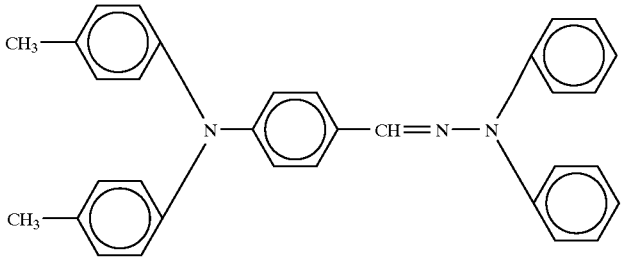
Comparative Compound (E)
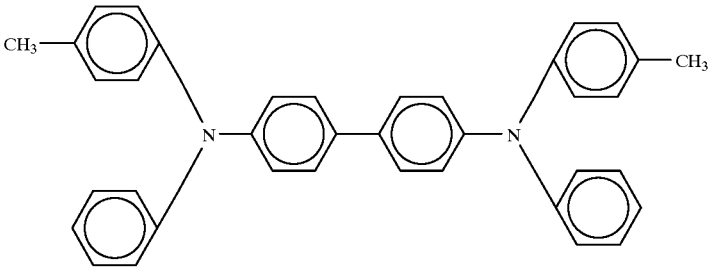
Comparative Compound (F)
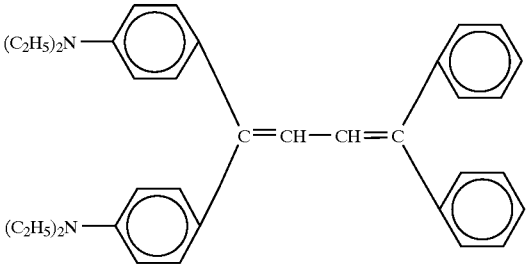
Comparative Compound (G)
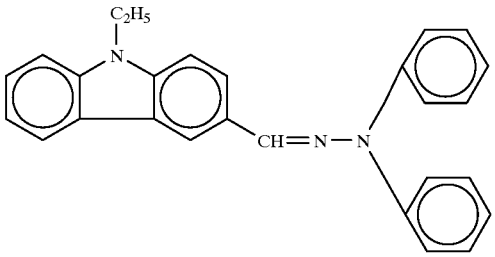
The results are shown in Tables 4 and 5 (Examples 16–28) and Tables 6 and 7 (Comparative Examples 14–23), respectively.

TABLE 4

| Ex. No. | Ex. Comp. No./ amount | | Initial $V_0(-V)$ | Initial $V_1(-V)$ | $E_{1/5}$ (lux · sec) | After 2000 sheets (23° C., 50% RH) $\Delta V_D(V)$ | After 2000 sheets (23° C., 50% RH) $\Delta V_L(V)$ | After 1000 sheets (30° C., 80% RH) $\Delta V_D'(V)$ | After 1000 sheets (30° C., 80% RH) $\Delta V_L'(V)$ |
|---|---|---|---|---|---|---|---|---|---|
| 16 | (1)-12 | 7 g | 700 | 690 | 1.5 | −15 | +5 | −20 | +10 |
| | (4)-5 | 3 g | | | | | | | |
| 17 | (1)-28 | 9 g | 701 | 706 | 1.1 | −5 | +5 | −10 | +5 |
| | (4)-39 | 1 g | | | | | | | |
| 18 | (1)-28 | 6 g | 698 | 695 | 1.2 | −5 | 0 | −12 | −5 |
| | (4)-39 | 4 g | | | | | | | |
| | (1)-28 | 4 g | 698 | 693 | 1.4 | −15 | +10 | −22 | +15 |
| 19 | (4)-39 | 6 g | | | | | | | |
| 20 | (1)-32 | 8 g | 701 | 691 | 1.5 | −13 | +10 | −18 | +5 |
| | (4)-24 | 2 g | | | | | | | |
| 21 | (1)-32 | 8 g | 700 | 699 | 1.2 | −2 | +3 | −8 | −5 |
| | (4)-34 | 2 g | | | | | | | |
| 22 | (1)-32 | 8 g | 699 | 697 | 1.1 | −5 | +1 | −10 | −5 |
| | (4)-39 | 2 g | | | | | | | |
| 23 | (1)-69 | 7 g | 760 | 690 | 1.5 | −14 | +12 | −21 | −5 |
| | (4)-2 | 3 g | | | | | | | |
| 24 | (1)-69 | 7 g | 700 | 696 | 1.2 | −6 | +5 | −12 | +5 |
| | (4)-45 | 3 g | | | | | | | |
| 25 | (1)-69 | 3 g | 701 | 690 | 1.5 | −15 | +10 | −22 | −10 |
| | (4)-45 | 7 g | | | | | | | |
| 26 | (1)-48 | 7 g | 700 | 692 | 1.5 | −15 | +10 | −21 | −5 |
| | (4)-31 | 3 g | | | | | | | |
| 27 | (1)-48 | 7 g | 695 | 692 | 1.2 | 0 | +5 | −5 | +15 |
| | (4)-39 | 3 g | | | | | | | |
| 28 | (1)-48 | 9 g | 701 | 698 | 1.1 | +5 | 0 | −5 | −10 |
| | (4)-39 | 1 g | | | | | | | |

TABLE 5

| Ex. No. | Ex. Comp. No./amount | | Crack* 1 hr | Crack* 2 hr | Crack* 4 hr | Crack* 8 hr | Crystallination* 1 day | Crystallination* 3 days | Crystallination* 5 days | Crystallination* 7 days |
|---|---|---|---|---|---|---|---|---|---|---|
| 16 | (1)-12 | 7 g | A | A | A | A | A | A | A | A |
| | (4)-5 | 3 g | | | | | | | | |
| 17 | (1)-28 | 9 g | A | A | A | A | A | A | A | A |
| | (4)-39 | 1 g | | | | | | | | |
| 18 | (1)-28 | 6 g | A | A | A | A | A | A | A | A |
| | (4)-39 | 4 g | | | | | | | | |
| 19 | (1)-28 | 4 g | A | A | A | A | A | A | A | A |
| | (4)-39 | 6 g | | | | | | | | |
| 20 | (1)-32 | 8 g | A | A | A | A | A | A | A | A |
| | (4)-24 | 2 g | | | | | | | | |
| 21 | (1)-32 | 8 g | A | A | A | A | A | A | A | A |
| | (4)-34 | 2 g | | | | | | | | |
| 22 | (1)-32 | 8 g | A | A | A | A | A | A | A | A |
| | (4)-39 | 2 g | | | | | | | | |
| 23 | (1)-69 | 7 g | A | A | A | A | A | A | A | A |
| | (4)-2 | 3 g | | | | | | | | |
| 24 | (1)-69 | 7 g | A | A | A | A | A | A | A | A |
| | (4)-45 | 3 g | | | | | | | | |
| 25 | (1)-69 | 3 g | A | A | A | A | A | A | A | A |
| | (4)-45 | 7 g | | | | | | | | |
| 26 | (1)-48 | 7 g | A | A | A | A | A | A | A | A |
| | (4)-31 | 3 g | | | | | | | | |
| 27 | (1)-48 | 7 g | A | A | A | A | A | A | A | A |
| | (4)-39 | 3 g | | | | | | | | |
| 28 | (1)-48 | 9 g | A | A | A | A | A | A | A | A |
| | (4)-39 | 1 g | | | | | | | | |

*Evaluation was performed as follows.

A: No crack in a photosensitive layer or no crystallization of charge transport material(s) occurred.

B: A crack in a photosensitive layer or a crystallization of charge transport material(s) occurred.

TABLE 6

| Comp. Ex. No. | Ex. Comp. No./ amount | | Initial $V_0(-V)$ | Initial $V_1(-V)$ | $E_{1/5}$ (lux · sec) | After 2000 sheets (23° C., 50% RH) $\Delta V_D(V)$ | After 2000 sheets (23° C., 50% RH) $\Delta V_L(V)$ | After 1000 sheets (30° C., 80% RH) $\Delta V_D'(V)$ | After 1000 sheets (30° C., 80% RH) $\Delta V_L'(V)$ |
|---|---|---|---|---|---|---|---|---|---|
| 14 | (1)-32 | 8g | 700 | 685 | 1.8 | −20 | +20 | −35 | +35 |
| | (D) | 2g | | | | | | | |
| 15 | (1)-32 | 8g | 698 | 682 | 1.9 | −25 | +25 | −40 | +30 |
| | (E) | 2g | | | | | | | |
| 16 | (1)-32 | 8g | 698 | 672 | 1.8 | −30 | +15 | −38 | +25 |
| | (F) | | | | | | | | |
| 17 | (G) | 8g | 701 | 670 | 2.1 | −35 | +25 | −45 | +25 |
| | (4)-34 | 2g | | | | | | | |
| 18 | (1)-28 | 10g | 700 | 682 | 1.9 | −25 | +28 | −32 | +35 |
| 19 | (4)-39 | 10g | 689 | 685 | 2.0 | −15 | +15 | −50 | −30 |
| 20 | (1)-32 | 10g | 698 | 681 | 2.1 | −15 | +19 | −40 | −35 |
| 21 | (4)-24 | 10g | 696 | 680 | 1.9 | −20 | +25 | −45 | −15 |
| 22 | (F) | 10g | 700 | 670 | 2.4 | −25 | +30 | −30 | −10 |
| 23 | (G) | 10g | 697 | 675 | 2.4 | −40 | +25 | −55 | −30 |

20

TABLE 7

| Comp. Ex. No. | Ex. Comp. No./amount | | Crack* 1 hr | Crack* 2 hr | Crack* 4 hr | Crack* 8 hr | Crystallination* 1 day | Crystallination* 3 days | Crystallination* 5 days | Crystallination* 7 days |
|---|---|---|---|---|---|---|---|---|---|---|
| 14 | (1)-32 | 8g | A | A | A | B | A | A | A | B |
| | (D) | 2g | | | | | | | | |
| 15 | (1)-32 | 8g | A | A | A | B | A | A | A | B |
| | (E) | 2g | | | | | | | | |
| 16 | (1)-32 | 8g | A | A | A | A | A | A | A | B |
| | (F) | 2g | | | | | | | | |
| 17 | (G) | 8g | A | A | A | B | A | A | A | B |
| | (4)-34 | 2g | | | | | | | | |
| 18 | (1)-28 | 10g | A | A | A | B | A | A | B | B |
| | (4)-39 | 10g | A | A | A | B | A | A | B | B |
| 20 | (1)-32 | 10g | A | A | B | B | A | A | A | B |
| 21 | (4)-24 | 10g | A | A | A | B | A | A | A | A |
| 22 | (F) | 10g | A | B | B | B | A | A | A | A |
| | (Q) | 10g | A | A | B | B | A | A | A | A |

*Evaluation was performed as follows.
A: No crack in a photosensitive layer or no crystallization of charge transport material(s) occurred.
B: A crack in a photosensitive layer or a crystallization of charge transport material(s) occurred.

EXAMPLE 29

Onto an aluminum sheet, a solution of 5 g of N-methoxymethylated 6-nylon (Mw=30,000) and 10 g of alcohol-soluble nylon copolymer (Mw=30,000) in 80 g of methanol was applied by wire bar coating, followed by drying to form a 1 μm-thick undercoat layer.

A coating liquid for a charge generation layer was prepared by mixing 5 g of oxytitaniumphthalocyanine, 4 g of a phenoxy resin and 160 g of cyclohexanone and dispersing the mixture for 70 hours in a ball mill.

The thus prepared coating liquid was applied onto the undercoat layer by blade coating to form a 0.2 μm-thick charge generation layer.

Then, 8 g of a fluorene compound (Ex. Comp. No. (1)-33), 2 g of an arylamine compound (Ex. Comp. No. (4)-48) and 13 g of a bisphenol Z-type polycarbonate resin (Mw=35,000) were dissolved in 70 g of a monochlorobenzene to prepare a coating liquid for a charge transport layer.

The coating liquid was applied onto the charge generation layer by blade coating, followed by drying to form a 17 μm-thick charge transport layer, thus preparing an electrophotographic photosensitive member.

The thus prepared photosensitive member was subjected to measurement of potentials $V_0$ and $V_1$ and the exposure quantity (energy) ($E_{1/6}$, μJ/cm$^2$) in a similar manner as in Example 1 except that the light source used in this example was laser light (output: 5 mW, emission wavelength: 780 nm) emitted from a semiconductor comprising gallium/aluminum/arsenic.

Then, the photosensitive member was left standing overnight in an environment of 15° C. and 10% RH and was bonded to a cylinder for a laser beam printer ("LBP-EX", mfd. by Canon K.K.). In the environment, the photosensitive member was subjected to measurement of fluctuations in light part potential ($V_L$) and residual potential ($V_r$) in the following manner to evaluate a potential stability.

First, a process cartridge including the photosensitive member wherein a developing device and a cleaner were removed was prepared. Then, whole area exposure corresponding to 5 sheets (A4 size) was performed and the surface potential (light part potential) of the fifth sheet was takes as $V_L$. Thereafter, the power for the primary charger was shut off while continuing the irradiation of the laser beam and the surface potential after five revolutions was measured and taken as a residual potential Vr.

In a similar manner, a light part potential $V_L'$ and a residual potential $V_r'$ were measured immediately after 1000 sheets of successive image formation at 15° C. and 10% RH.

The fluctuations $\Delta V_L$ and $\Delta Vr$ in $V_L$ and Vr between the initial stage and after 1000 sheets of image formation were determined according to the following equations, respectively.

$$\Delta V_L = |V_L - V_L'|$$

$$\Delta Vr = |Vr - Vr'|$$

Separately, the photosensitive member was evaluated in respect of the crack and crystallization in the same manner as in Example 16.

The results are shown in Table 8 appearing hereinafter.

EXAMPLES 30–35 AND COMPARATIVE EXAMPLES 24–29

Photosensitive members were prepared and evaluated in the same manner as in Example 29 except for using the charge transport material(s) shown in Table 8 including the following comparative compounds (H), (I) and (J).

Comparative compound (H)

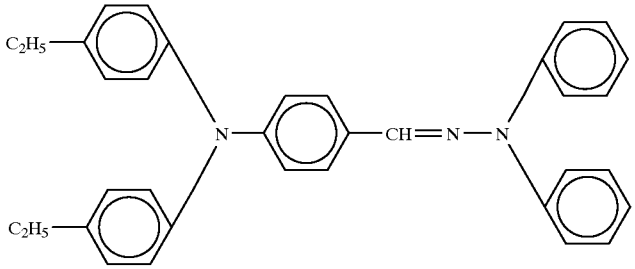

Comparative compound (I)

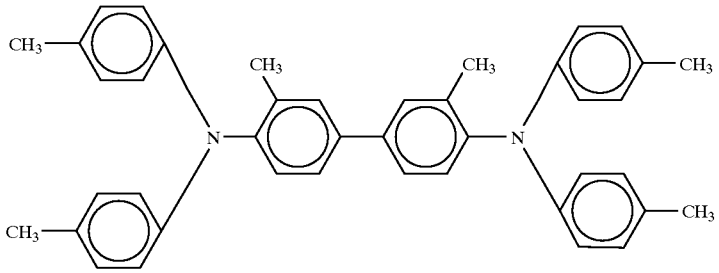

Comparative compound (J)

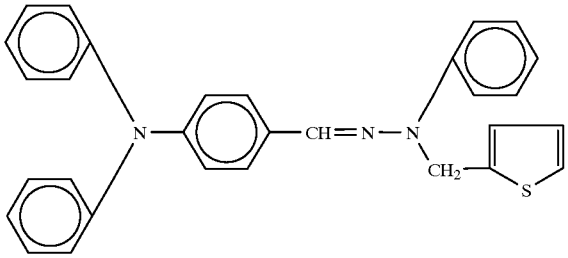

The results are shown in Table 8.

TABLE 8

| Ex. No. | Ex. Comp. No./ amount | | Initial $V_0$(−V) | Initial $V_1$(−V) | $E_{1/6}$ (μJ/cm²) | After 1000 sheets $\Delta V_L$(V) | After 1000 sheets $\Delta V_r$(V) | Crack* 1 hr | Crack* 2 hr | Crack* 4 hr | Crack* 8 hr | Crystallination* 1 day | Crystallination* 3 days | Crystallination* 5 days | Crystallination* 7 days |
|---|---|---|---|---|---|---|---|---|---|---|---|---|---|---|---|
| Ex. 29 | (1)-33 | 8g | 700 | 697 | 1.4 | 5 | 4 | A | A | A | A | A | A | A | A |
| | (4)-48 | 2g | | | | | | | | | | | | | |
| Ex. 30 | (1)-28 | 8g | 701 | 696 | 1.3 | 10 | 3 | A | A | A | A | A | A | A | A |
| | (4)-47 | 2g | | | | | | | | | | | | | |
| Ex. 31 | (1)-69 | 8g | 697 | 690 | 1.6 | 15 | 10 | A | A | A | A | A | A | A | A |
| | (4)-47 | 2g | | | | | | | | | | | | | |
| Ex. 32 | (1)-49 | 6g | 696 | 690 | 1.7 | 15 | 12 | A | A | A | A | A | A | A | A |
| | (4)-20 | 4g | | | | | | | | | | | | | |
| Ex. 33 | (1)-48 | 7g | 701 | 698 | 1.2 | 5 | 2 | A | A | A | A | A | A | A | A |
| | (4)-47 | 3g | | | | | | | | | | | | | |
| Ex. 34 | (1)-34 | 7g | 698 | 695 | 1.3 | 0 | 5 | A | A | A | A | A | A | A | A |
| | (4)-39 | 3g | | | | | | | | | | | | | |
| Ex. 35 | (1)-34 | 7g | 700 | 690 | 1.7 | 16 | 10 | A | A | A | A | A | A | A | A |
| | (4)-28 | 3g | | | | | | | | | | | | | |
| Comp. Ex. 24 | (H) | 10g | 698 | 685 | 2.1 | 35 | 55 | A | A | B | B | A | B | B | B |
| Comp. Ex. 25 | (1)-28 | 8g | 695 | 680 | 1.9 | 30 | 35 | A | A | A | B | A | A | A | A |
| | (I) | 2g | | | | | | | | | | | | | |
| Comp. Ex. 26 | (I) | 8g | 698 | 682 | 2.2 | 45 | 30 | A | A | B | B | A | A | A | A |
| | (4)-47 | 2g | | | | | | | | | | | | | |
| Comp. Ex. 27 | (1)-28 | 10g | 700 | 680 | 1.9 | 15 | 30 | A | A | A | B | A | A | B | B |
| Comp. Ex. 28 | (4)-47 | 10g | 701 | 685 | 1.9 | 35 | 20 | A | A | A | B | A | A | A | A |
| Comp. Ex. 29 | (J) | 10g | 699 | 675 | 2.4 | 25 | 45 | A | A | B | B | A | A | A | A |

*Evaluation was performed as follows.
A: No crack in a photosensitive layer or no crystallization of charge transport material(s) occurred.
B: A crack in a photosensitive layer or a crystallization of charge transport material(s) occurred.

What is claimed is:

1. An electrophotographic photosensitive member comprising a support and a photosensitive layer disposed on the support, wherein said photosensitive layer contains a charge-generating material and charge-transporting materials, said charge-transporting materials comprise at least:

a fluorene compound represented by a formula (1) shown below and a stilbene compound represented by a formula (4) shown below, (1)

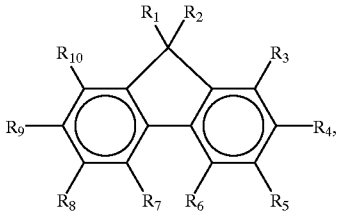

wherein $R_1$ and $R_2$ independently denote a substituted or unsubstituted alkyl group, a substituted or unsubstituted aryl group, or a substituted or unsubstituted aralkyl group, $R_1$ and $R_2$ being optionally connected with each other to form a ring structure; and $R_3$ to $R_{10}$ independently denote a substituted or unsubstituted diarylamino group, a substituted or unsubstituted alkyl group, a substituted or unsubstituted aryl group, a substituted or unsubstituted aralkyl group, halogen atom, nitro group or hydrogen atom, at least two of $R_3$ to $R_{10}$ being a substituted or unsubstituted diarylamino group;

(4)

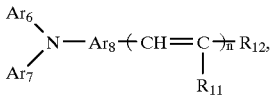

wherein $Ar_6$ and $Ar_7$ independently denote a substituted or unsubstituted aryl group or a substituted or unsubstituted heterocyclic group; $Ar_8$ denotes a substituted or unsubstituted arylene group or a substituted or unsubstituted divalent heterocyclic group; $R_{11}$ and $R_{12}$ independently denote a substituted or unsubstituted alkyl group, a substituted or unsubstituted aryl group, a substituted or unsubstituted heterocyclic group or hydrogen atom, $R_{11}$ and $R_{12}$ being optionally connected with each other to form a ring structure when n is 1; and n is 1 or 2.

2. A member according to claim 1, wherein said photosensitive layer constitutes a surface layer.

3. A member according to claim 2, wherein said photosensitive layer comprises a charge generation layer and a charge transport layer, said charge transport layer constituting a surface layer and containing the fluorene compound of the formula (1) and the stilbene compound of the formula (4).

4. A member according to claim 1, wherein each of said substituted groups for $R_3$ to $R_{10}$ in the formula (1) has a substituent selected from the group consisting of an alkyl group, an aralkyl group, an aryl group, a heterocyclic group, an alkoxy group, an aryloxy group, halogen atom, nitro group, cyano group and hydroxyl group.

5. A process cartridge, detachably mountable to an electrophotographic apparatus main body, comprising: an electrophotographic photosensitive member according to claim 1 and at least one means selected from the group consisting of charging means, developing means and cleaning means.

6. An electrophotographic apparatus, comprising: an electrophotographic photosensitive member according to claim 1, charging means, exposure means, developing means and transfer means.

* * * * *